US009280102B2

(12) United States Patent
Hasegawa

(10) Patent No.: US 9,280,102 B2
(45) Date of Patent: Mar. 8, 2016

(54) IMAGE HEATING APPARATUS AND IMAGE FORMING APPARATUS

(71) Applicant: CANON KABUSHIKI KAISHA, Tokyo (JP)

(72) Inventor: Takuya Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/083,994

(22) Filed: Nov. 19, 2013

(65) Prior Publication Data

US 2014/0153981 A1 Jun. 5, 2014

(30) Foreign Application Priority Data

Nov. 30, 2012 (JP) ..... 2012-263768

(51) Int. Cl.
*G03G 15/20* (2006.01)

(52) U.S. Cl.
CPC ..... *G03G 15/2039* (2013.01); *G03G 15/2053* (2013.01); *G03G 2215/00143* (2013.01); *G03G 2215/2019* (2013.01)

(58) Field of Classification Search
USPC ..... 399/329
See application file for complete search history.

(56) References Cited

U.S. PATENT DOCUMENTS

| | | | | |
|---|---|---|---|---|
| 6,078,766 | A * | 6/2000 | Kurotaka | 399/165 |
| 6,181,900 | B1 * | 1/2001 | Lee et al. | 399/165 |
| 6,198,902 | B1 | 3/2001 | Vaughan et al. | |
| 6,799,000 | B2 * | 9/2004 | Aslam et al. | 399/45 |
| 7,711,306 | B2 | 5/2010 | Kagawa | |
| 8,295,750 | B2 * | 10/2012 | Yamana | 399/328 |
| 8,374,519 | B2 | 2/2013 | Motoyama | |
| 8,417,150 | B2 | 4/2013 | Kameda | |
| 8,857,602 | B2 * | 10/2014 | Clevers et al. | 198/807 |
| 2005/0214043 | A1 * | 9/2005 | Kameda | 399/328 |

(Continued)

FOREIGN PATENT DOCUMENTS

| | | |
|---|---|---|
| EP | 2 629 153 A2 | 8/2013 |
| EP | 2 713 222 A2 | 4/2014 |

(Continued)

OTHER PUBLICATIONS

U.S. Appl. No. 14/178,557 to Takuya Hasegawa, filed Feb. 12, 2014.

(Continued)

*Primary Examiner* — Rochelle-Ann J Blackman
*Assistant Examiner* — Linda B Smith
(74) *Attorney, Agent, or Firm* — Fitzpatrick, Cella, Harper & Scinto

(57) ABSTRACT

An image heating apparatus includes: a rotatable heating member; a belt unit including an endless belt configured to heat the rotatable heating member, and a supporting portion configured to rotatably support an inner surface of the belt; a holding portion configured to rotatably hold the belt unit; a detecting portion configured to detect that the belt is out of a predetermined zone with respect to a widthwise direction of the belt; a tilting portion configured to tilt the belt unit relative to the holding portion in a direction of causing the belt to return into the predetermined zone on the basis of an output of the detecting portion; and a limiting portion configured to limit tilting of the belt unit to an angle exceeding a predetermined angle range wider than an angle range in which the belt unit is capable of being tilted by the tilting portion.

20 Claims, 16 Drawing Sheets

(56) References Cited

U.S. PATENT DOCUMENTS

| | | | | |
|---|---|---|---|---|
| 2005/0226660 | A1* | 10/2005 | Fuma | 399/328 |
| 2007/0147894 | A1* | 6/2007 | Yokota | 399/165 |
| 2007/0189817 | A1 | 8/2007 | Kagawa | |
| 2008/0112738 | A1* | 5/2008 | Yoshino et al. | 399/329 |
| 2008/0213009 | A1* | 9/2008 | Kamoshita et al. | 399/313 |
| 2009/0087233 | A1* | 4/2009 | Sakuma | 399/313 |
| 2009/0214275 | A1 | 8/2009 | Yamana | |
| 2009/0317115 | A1 | 12/2009 | Motoyama | |
| 2011/0142496 | A1* | 6/2011 | Kameda | 399/122 |
| 2011/0188872 | A1* | 8/2011 | Nara et al. | 399/67 |
| 2011/0243607 | A1* | 10/2011 | Takahashi | 399/122 |
| 2013/0051875 | A1* | 2/2013 | Takahashi | 399/329 |
| 2013/0209145 | A1 | 8/2013 | Hasegawa | |
| 2014/0086647 | A1 | 3/2014 | Hasegawa | |
| 2014/0093287 | A1 | 4/2014 | Hasegawa | |

FOREIGN PATENT DOCUMENTS

| | | | |
|---|---|---|---|
| JP | 11-116089 | A | 4/1999 |
| JP | 2007139809 | A | 6/2007 |
| JP | 2007-212896 | A | 8/2007 |
| JP | 2009-300911 | A | 12/2009 |
| JP | 2010097151 | A | 4/2010 |
| JP | 2011123414 | A | 6/2011 |
| WO | 2013/008943 | A1 | 1/2013 |

OTHER PUBLICATIONS

U.S. Appl. No. 14/178,542 to Takuya Hasegawa, filed Feb. 12, 2014.

U.S. Appl. No. 14/091,669 to Takuya Hasegawa, filed Nov. 27, 2013.

Great Britain Office Action dated May 20, 2014, in counterpart UK Application No. GB1320372.4.

Chinese Office Action dated Jul. 2, 2015, in counterpart Chinese Application No. 201310629515.3.

Office Action issued in Korean Patent Application No. 10-2013-0147336, mailed Jan. 12, 2016.

* cited by examiner (a)

(b)

(a)

(b)

(a)

(b)

(c)

IMAGE HEATING APPARATUS AND IMAGE FORMING APPARATUS

FIELD OF THE INVENTION AND RELATED ART

The present invention relates to an image forming apparatus such as a printer, a copying machine, a facsimile machine or a multi-function machine having a plurality of functions of these machines, and relates to an image heating apparatus usable in such an image forming apparatus.

Various image forming apparatuses have been conventionally known, but those of the electrophotographic type have come into wide use. Such image forming apparatuses are required to provide high productivity (the print number per unit time) with respect to various sheets (recording materials) such as thick paper.

Incidentally, in the image forming apparatus of the electrophotographic type as described above, particularly in order to improve the productivity with respect to the thick paper having a large basis weight, speed-up of a fixing speed of a fixing device or apparatus (image heating apparatus) is required. However, in the case of the thick paper, compared with the case of thin paper, heat in a large amount is taken from the fixing device with sheet passing, and therefore a heat quantity required for fixing becomes large. For that reason, in the case of the thick paper, a coping method in which the productivity is lowered (by decreasing the fixing speed or the print number per unit time) has been known.

As a coping method in which the productivity is not lowered with respect to the thick paper, an externally heating type (method) in which a member is contacted to an outer surface of a fixing roller (rotatable heating member) to maintain an outer surface temperature of the fixing roller has been devised. As such an externally heating type, in order to improve a fixing roller temperature maintaining performance by remarkably increasing a contact area with the fixing roller, use of an externally heating belt (endless belt) rotatably stretched by two supporting rollers has been proposed (Japanese Laid-Open Patent Application (JP-A) 2007-212896).

However, it is actually difficult to assemble the externally heating belt with the two supporting rollers with high accuracy of parallelism between the two supporting rollers and to maintain the parallelism with high accuracy. As a result, when the parallelism between the two supporting rollers is not ensured, the externally heating belt is shifted in a widthwise direction thereof, so that there is a fear that travelling stability of the externally heating belt becomes worse.

Therefore, with respect to such a fear, it would be considered that a method in which the (lateral) shift of the externally heating belt is controlled by inclining one of the supporting rollers with respect to the other supporting roller is used, but in the case of the externally heating belt performing a function of heating the fixing roller, it is difficult to employ this method.

This is because in the cases of this method, a constitution in which an end side of one of the supporting roller with respect to an axial direction is displaced with respect to another end side of the one of the supporting rollers is employed, but there is a fear that a part of a region where the externally heating belt is to be contacted to the fixing roller is separated (spaced) from the fixing roller by displacement of this one of the supporting roller. As a result, a function of the externally heating belt for heating the fixing roller is impaired, so that improper fixing is invited.

SUMMARY OF THE INVENTION

A principal object of the present invention is to provide an image heating apparatus capable of improving traveling stability of an endless belt.

Another object of the present invention is to provide an image forming apparatus capable of improving the traveling stability of the endless belt.

According to an aspect of the present invention, there is provided an image heating apparatus comprising: a rotatable heating member configured to heat an image on a sheet; a belt unit including an endless belt configured to heat the rotatable heating member in contact with an outer surface of the rotatable heating member, and a supporting portion configured to rotatably support an inner surface of the endless belt; a holding portion configured to rotatably hold the belt unit; a detecting portion configured to detect that the endless belt is out of a predetermined zone with respect to a widthwise direction of the endless belt; a tilting portion configured to tilt the belt unit relative to the holding portion in a direction of causing the endless belt to return into the predetermined zone on the basis of an output of the detecting portion; and a limiting portion configured to limit tilting of the belt unit to an angle exceeding a predetermined angle range wider than an angle range in which the belt unit is capable of being tilted by the tilting portion.

According to another aspect of the present invention, there is provided an image forming apparatus comprising: a belt unit including an endless belt and a supporting portion configured to rotatably support an inner surface of the endless belt; a rotatable driving member configured to rotate the endless belt by rotation thereof in contact with an outer surface of the endless belt; a holding portion configured to rotatably hold the belt unit; a detecting portion configured to detect that the endless belt is out of a predetermined zone with respect to a widthwise direction of the endless belt; a tilting portion configured to tilt the belt unit relative to the holding portion in a direction of causing the endless belt to return into the predetermined zone on the basis of an output of the detecting portion; and a limiting portion configured to limit tilting of the belt unit to an angle exceeding a predetermined angle range wider than an angle range in which the belt unit is capable of being tilted by the tilting portion.

These and other objects, features and advantages of the present invention will become more apparent upon a consideration of the following description of the preferred embodiments of the present invention taken in conjunction with the accompanying drawings.

Figure 4:
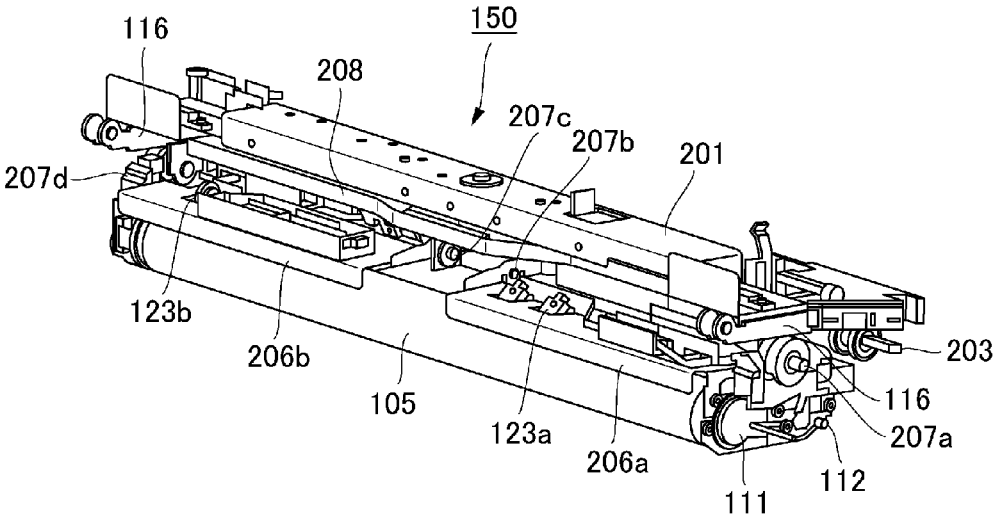
Figure 4:
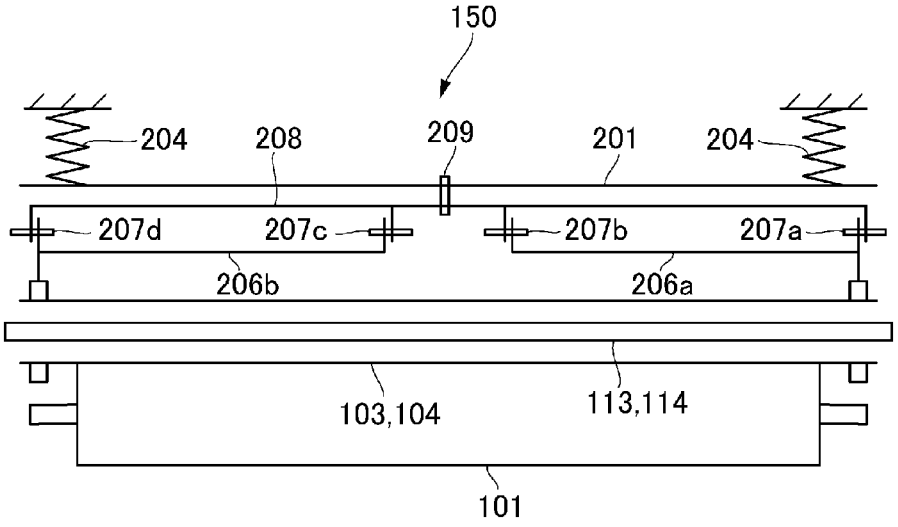

Parts (a) and (b) of FIG. 4 are a perspective view and a mechanism view, respectively, of an externally heating unit.

Figure 5:
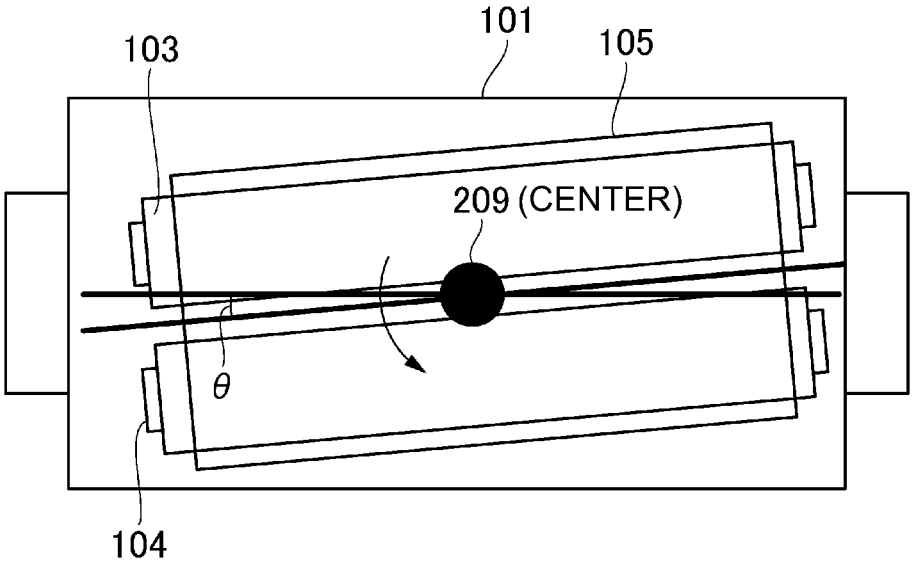

FIG. 5 is an illustration of a crossing angle between a fixing roller and the externally heating belt.

Figure 6:
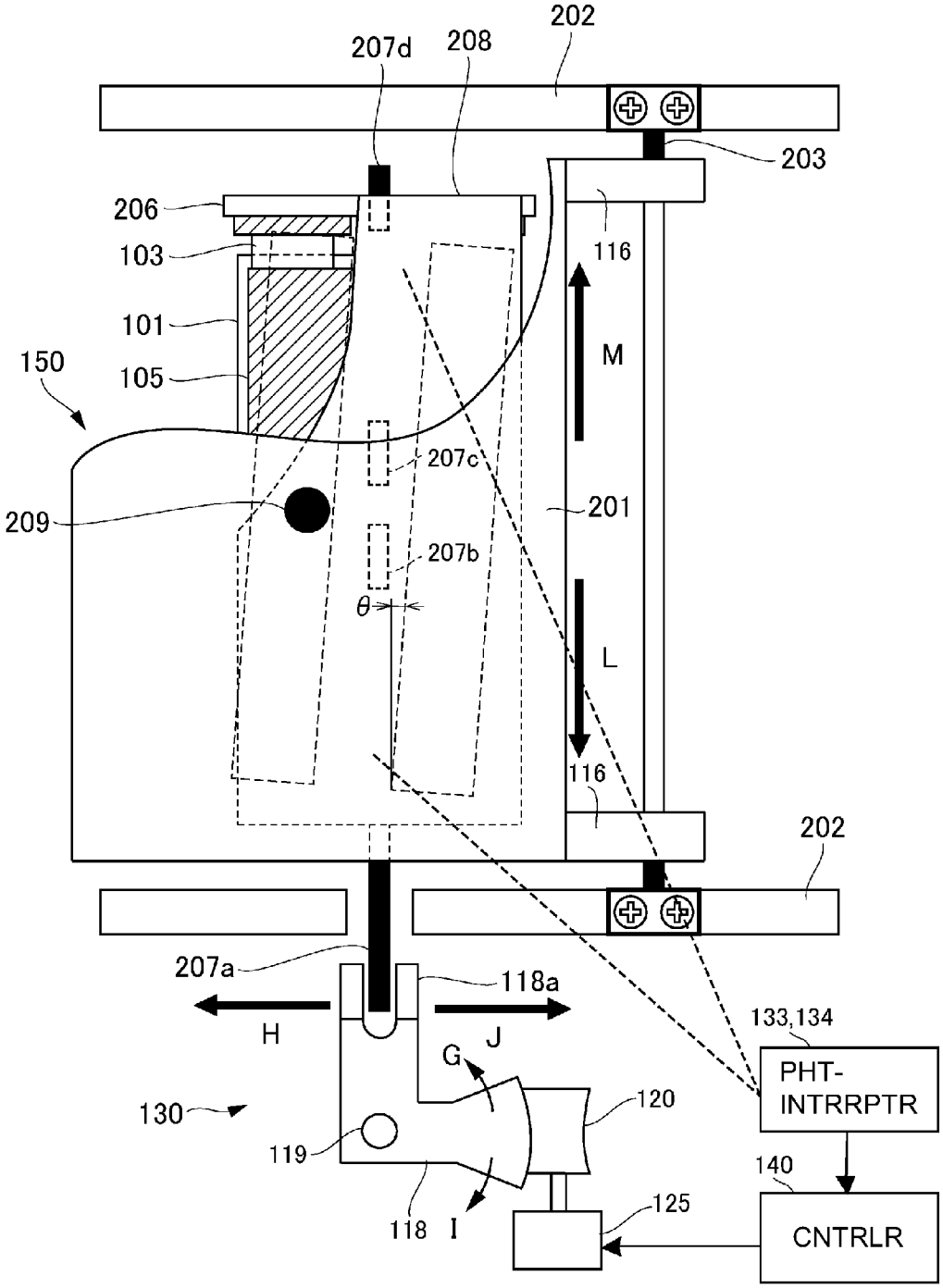

FIG. 6 is an illustration of a steering mechanism for the externally heating belt.

Figure 7:
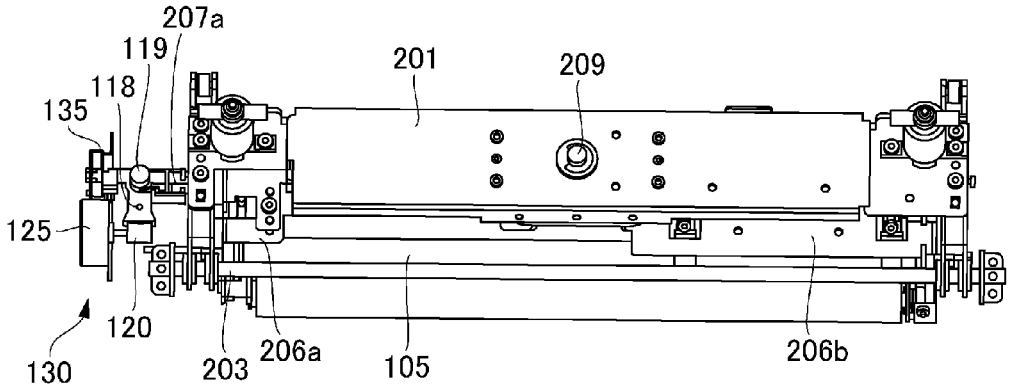

FIG. 7 is an illustration of a driving portion of the steering mechanism.

Figure 8:
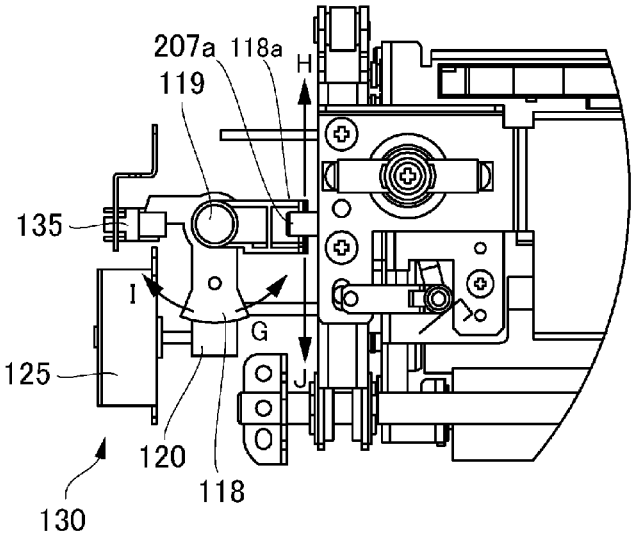

FIG. 8 is an enlarged view of the driving portion of the steering mechanism.

Figure 9:
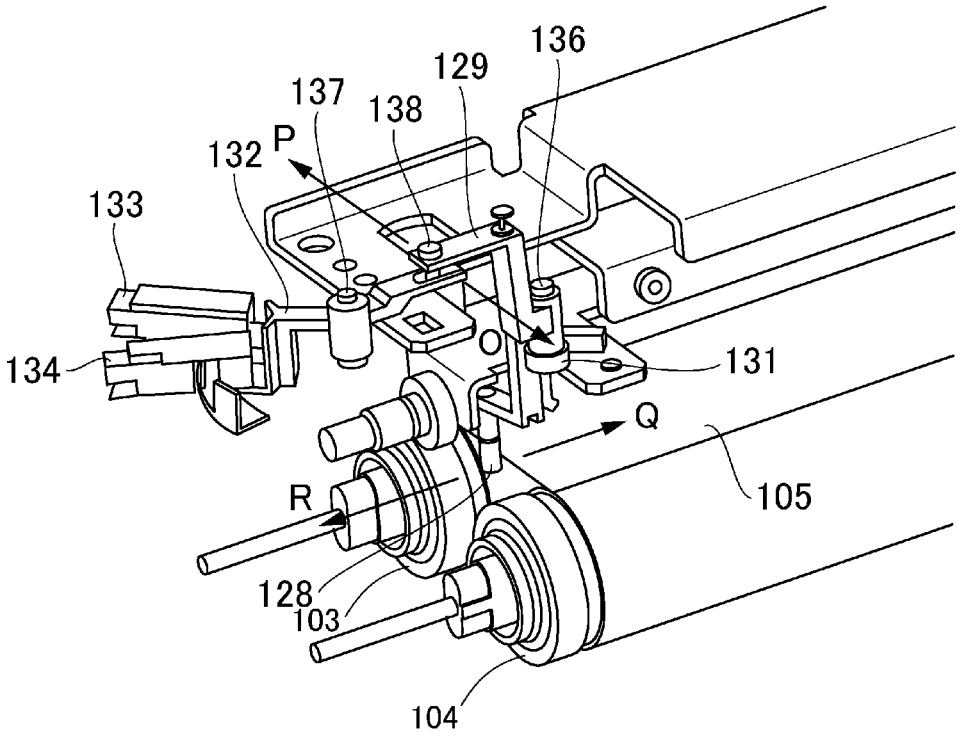

FIG. 9 is an illustration of an arrangement of a belt position sensor.

Figure 10:
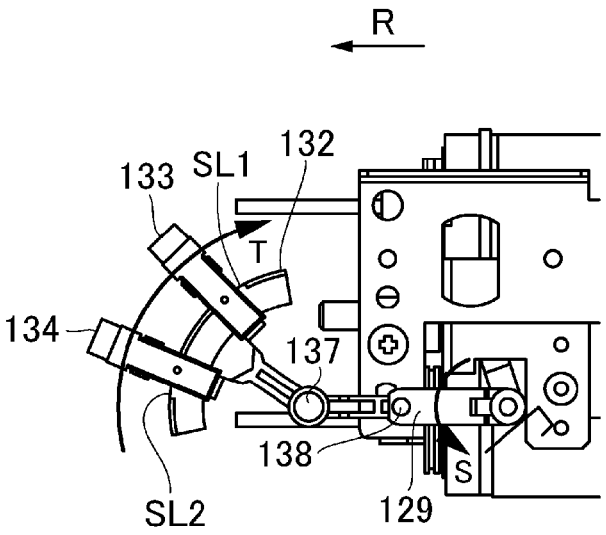
Figure 10:
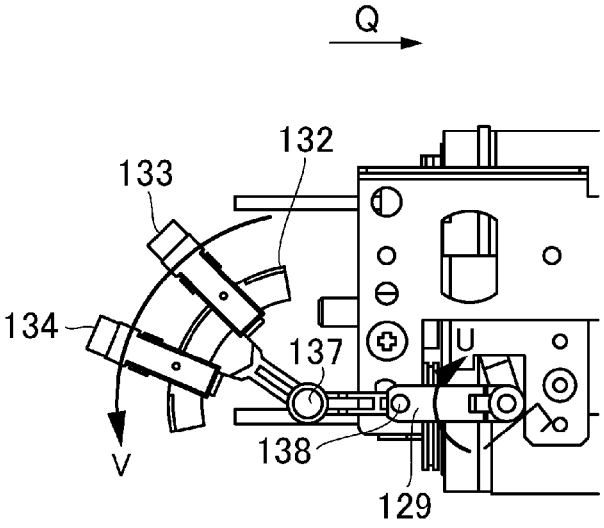

Part (a) of FIG. 10 is an illustration of a relationship between a belt lateral deviation direction and a rotational direction of a sensor flag in the case where the belt is shifted in a longitudinal front side, and (b) of FIG. 10 is an illustration of the relationship between the belt lateral deviation direction and the rotational direction of the sensor flag in the case where the belt is shifted in a longitudinal rear side.

Figure 11:
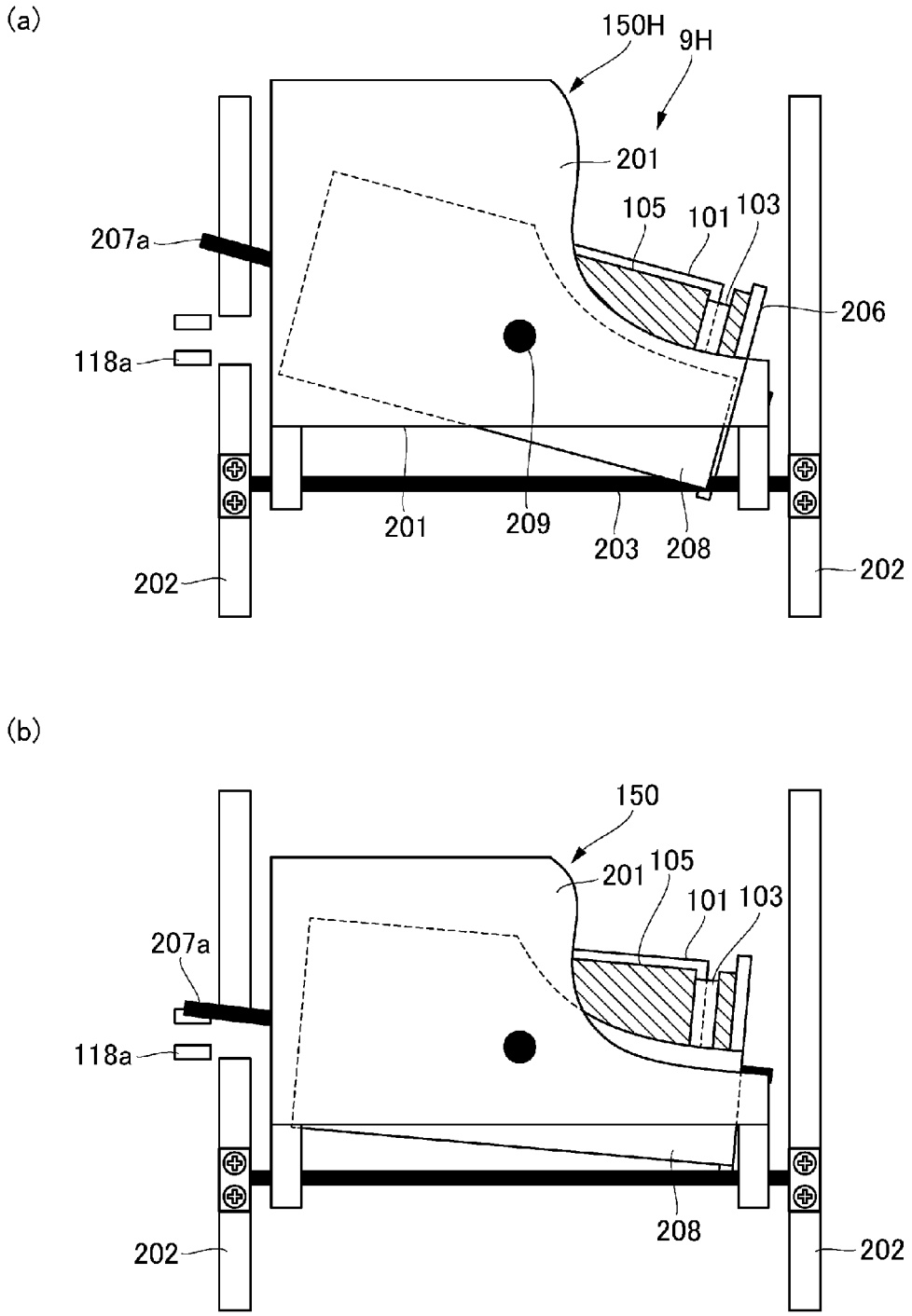

Part (a) of FIG. 11 is an illustration of rotation of a swingable frame in a fixing device in Comparison example, and (b) of FIG. 11 is an illustration of rotation of a swingable frame in the fixing device in Embodiment 1.

Figure 12:
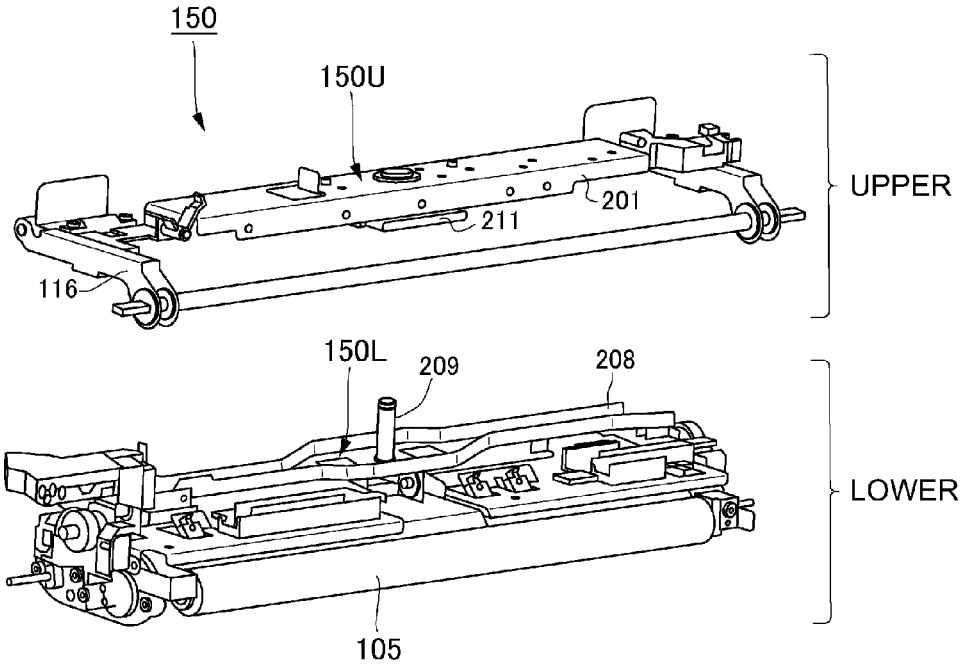

FIG. 12 is an illustration of a structure of an externally heating unit.

Figure 13:
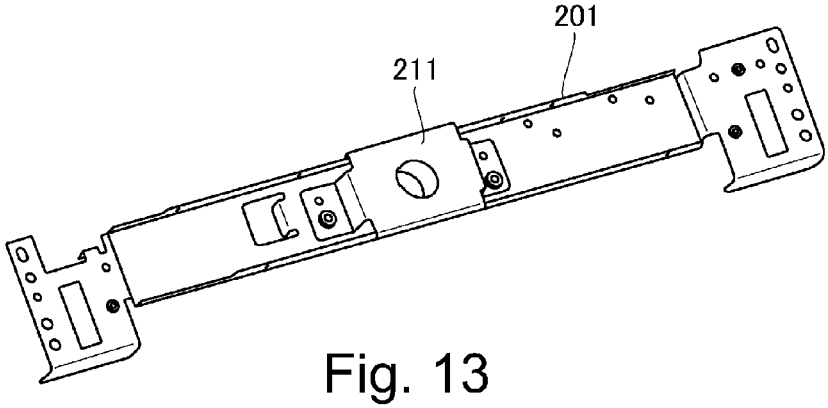

FIG. 13 is an illustration of a structure of a pressing frame.

Figure 14:
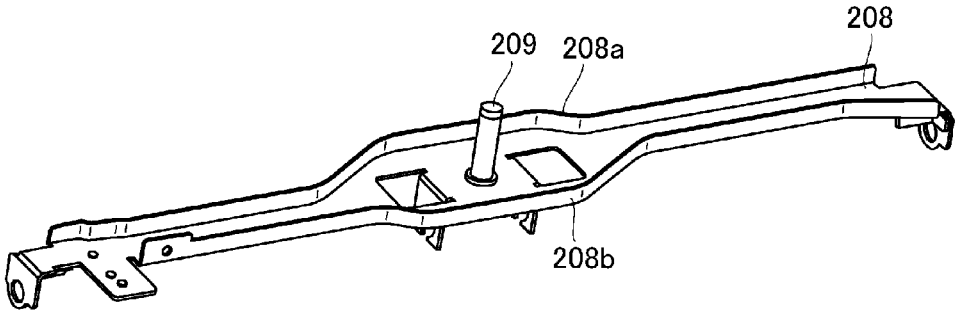

FIG. 14 is an illustration of a structure of the swingable frame.

Figure 15:
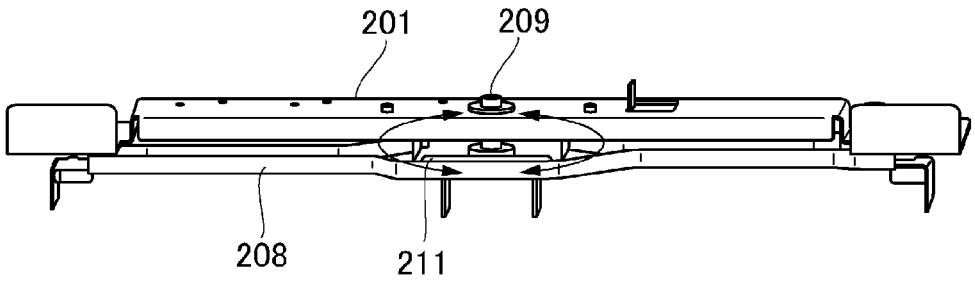
Figure 15:
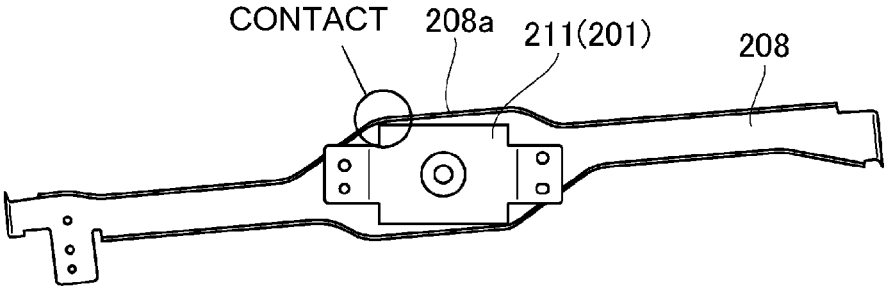
Figure 15:
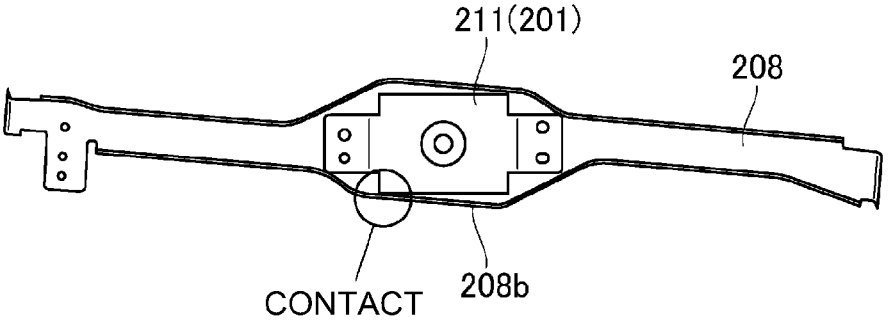

Parts (a), (b) and (c) of FIG. 15 are illustrations of tilt (rotation) limitation of the swingable frame.

Figure 16:
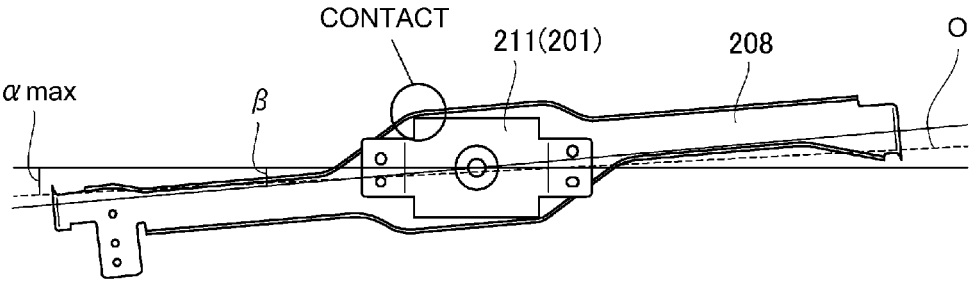

FIG. 16 is an illustration of a relationship between a crossing angle and tilt limit angle.

Figure 17:
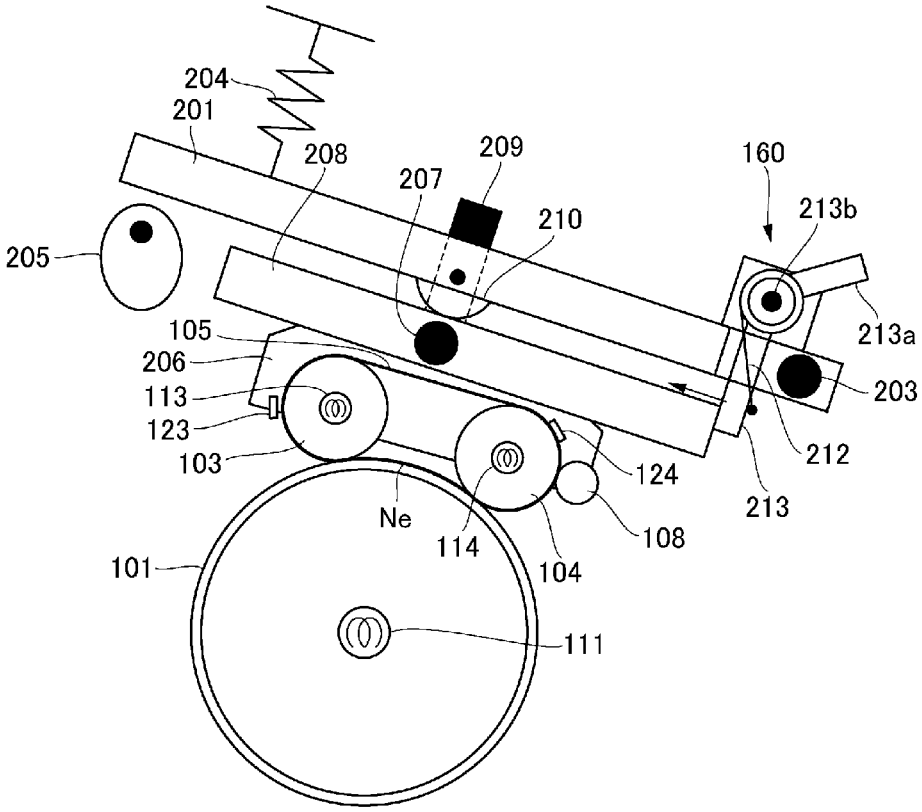

FIG. 17 is a front view of a demounted state of an externally heating unit in Embodiment 2.

Figure 18:
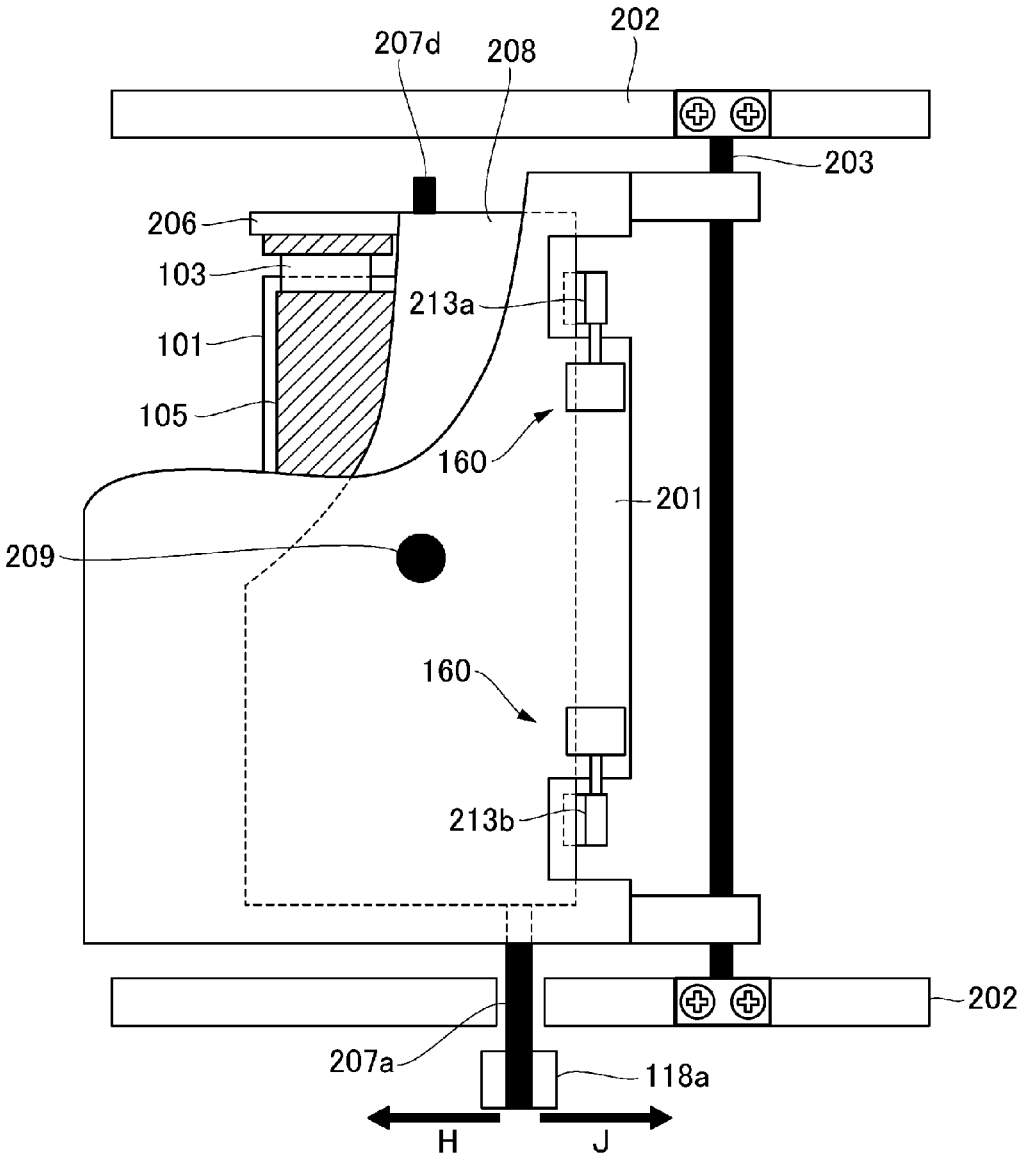

FIG. 18 is a plan view of the demounted state of the externally heating unit in Embodiment 2.

Figure 19:
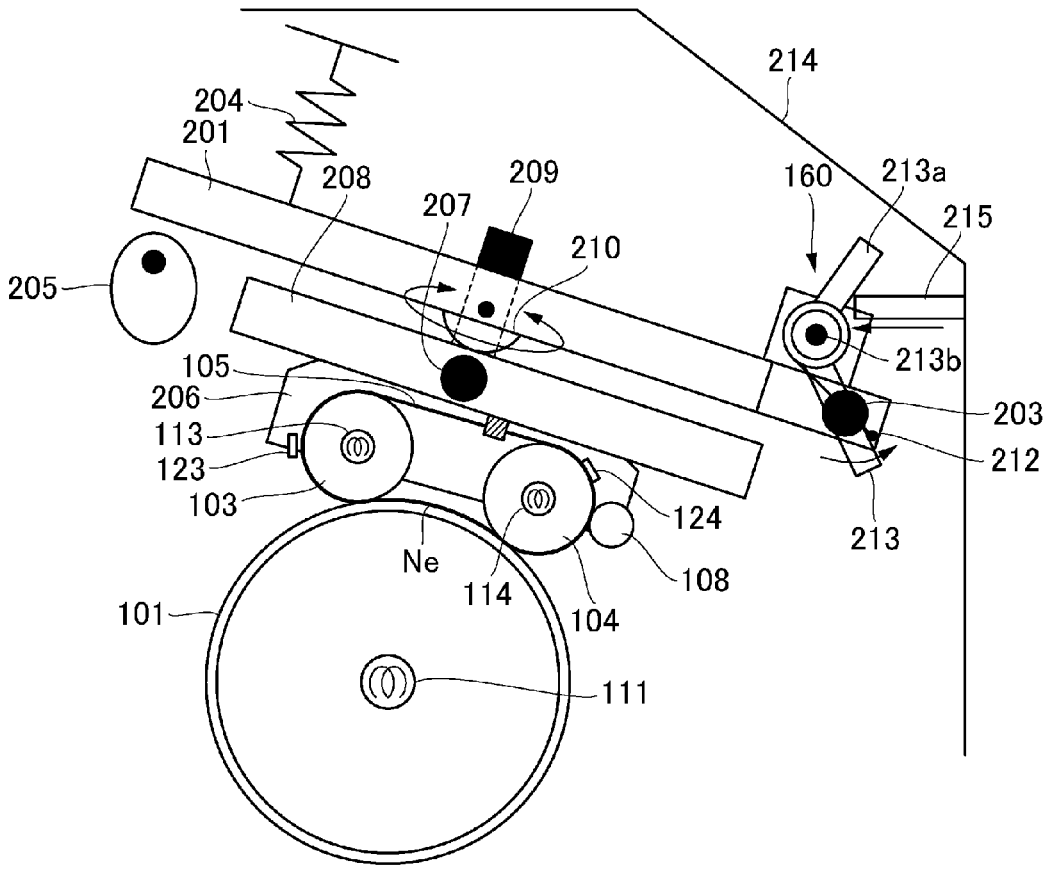

FIG. 19 is a front view of a mounted state of the externally heating unit in Embodiment 2.

Figure 20:
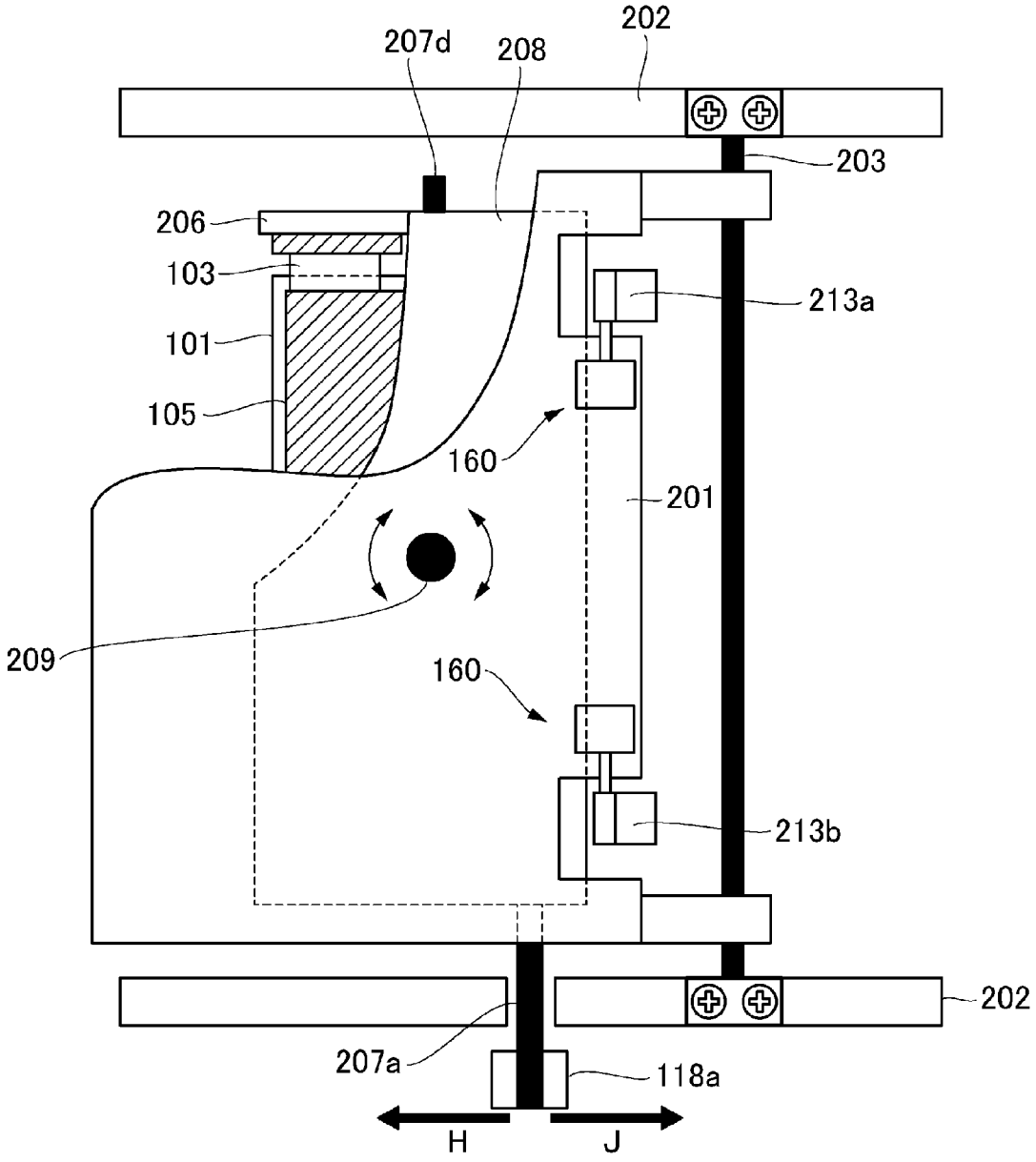

FIG. 20 is a plan view of the mounted state of the externally heating unit in Embodiment 2.

DESCRIPTION OF THE PREFERRED EMBODIMENTS

Embodiments of the present invention will be specifically described below with reference to the drawings.

(Embodiment 1)

<Image Forming Apparatus>

Figure 1:
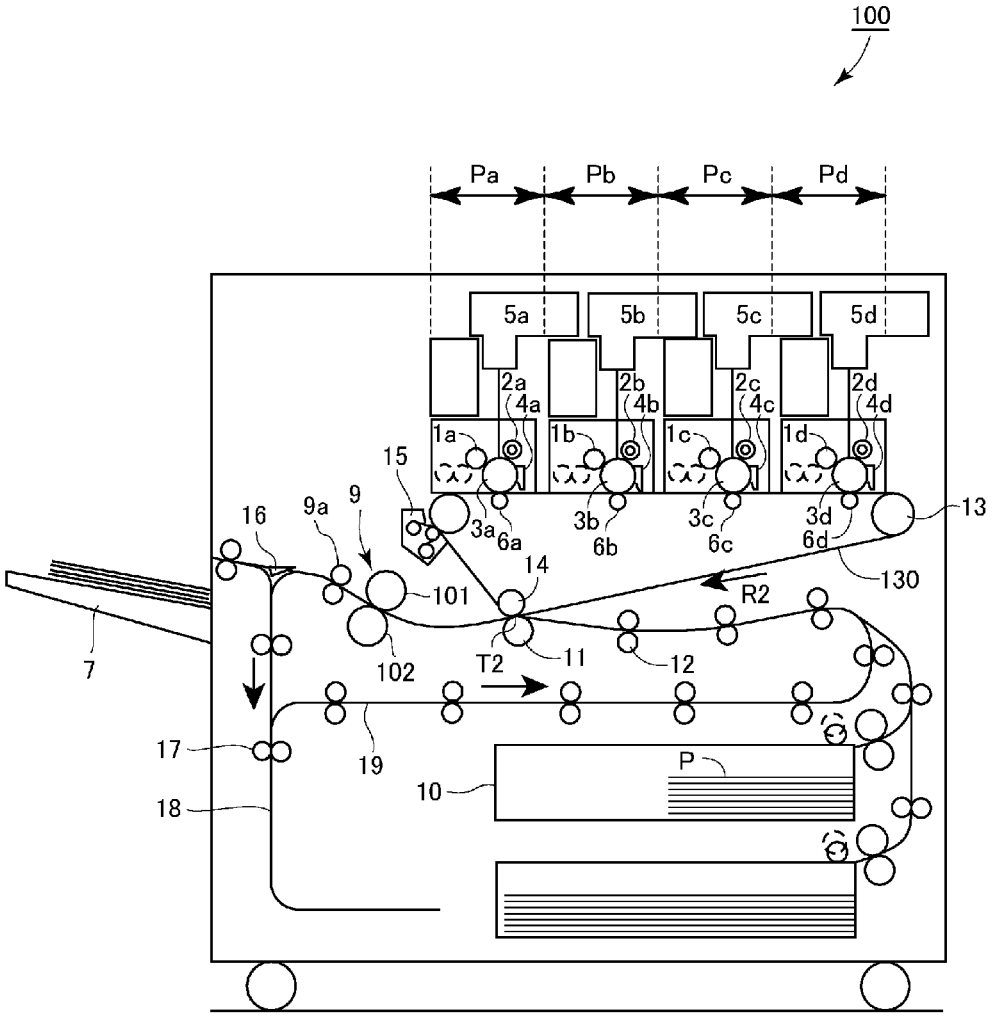
FIG. 1 is an illustration of a structure of an image forming apparatus.

FIG. 1 is an illustration of a structure of an image forming apparatus 100. As shown in FIG. 1, the image forming apparatus 100 is a tandem-type full-color printer of an intermediary transfer type in which image forming portions Pa, Pb, Pc and Pd for yellow, magenta, cyan and black, respectively are arranged along an intermediary transfer belt 130.

In the image forming portion Pa, a yellow toner image is formed on a photosensitive drum 3*a*, and then is primary-transferred onto the intermediary transfer belt 130. In the image forming portion Pb, a magenta toner image is formed on a photosensitive drum 3*b*, and then is primary-transferred onto the intermediary transfer belt 130. In the image forming portions Pc and Pd, a cyan toner image and a black toner image are formed on photosensitive drums 3*c* and 3*d*, respectively, and then are primary-transferred successively onto the intermediary transfer belt 130.

A recording material P is taken out from a recording material cassette 10 one by one by and is in stand-by between registration rollers 12. The recording material P is sent by the registration rollers 12 to a secondary transfer portion T2 while being timed to the toner images on the intermediary transfer belt 130. The recording material P on which the four color toner images are secondary-transferred from the intermediary transfer belt 130 while being conveyed through the secondary transfer portion T2 is conveyed into a fixing device (apparatus) 9 and then is heated and pressed by the fixing device 9 to fix the toner images thereon. Thereafter, the recording material P is discharged onto a tray 7 outside the image forming apparatus.

The image forming portions Pa, Pb, Pc and Pd have the substantially same constitution except that the colors of toners of yellow, magenta, cyan and black used in developing devices 1*a*, 1*b*, 1*c* and 1*d* are different from each other. In the following description, the image forming portion Pa will be described and other image forming portions Pb, Pc and Pd will be omitted from redundant description.

The image forming portion Pa includes the photosensitive drum 3*a* around which a charging roller 2*a*, an exposure device 5*a*, the developing device 1*a*, a primary transfer roller 6*a*, and a drum cleaning device 4*a* are provided. The photosensitive drum 3*a* is prepared by forming a photosensitive layer on the surface of an aluminum cylinder. The charging roller 2*a* electrically charges the surface of the photosensitive drum 3*a* to a uniform potential. The exposure device 5*a* writes (forms) an electrostatic image for an image on the photosensitive drum 3*a* by scanning with a laser beam. The developing device 1*a* develops the electrostatic image to form the toner image on the photosensitive drum 3*a*. The primary transfer roller 6*a* is supplied with a voltage, so that the toner image on the photosensitive drum 3*a* is primary-transferred onto the intermediary transfer belt 130.

The drum cleaning device 4*a* rubs the photosensitive drum 3*a* with a cleaning blade to collect a transfer residual toner deposited on the photosensitive drum 3*a* without being transferred onto the intermediary transfer belt 130. A belt cleaning 15 collects a transfer residual toner deposited on the intermediary transfer belt 130 without being transferred onto the recording material P at the secondary transfer portion T2.

(Fixing Device)

Figure 2:
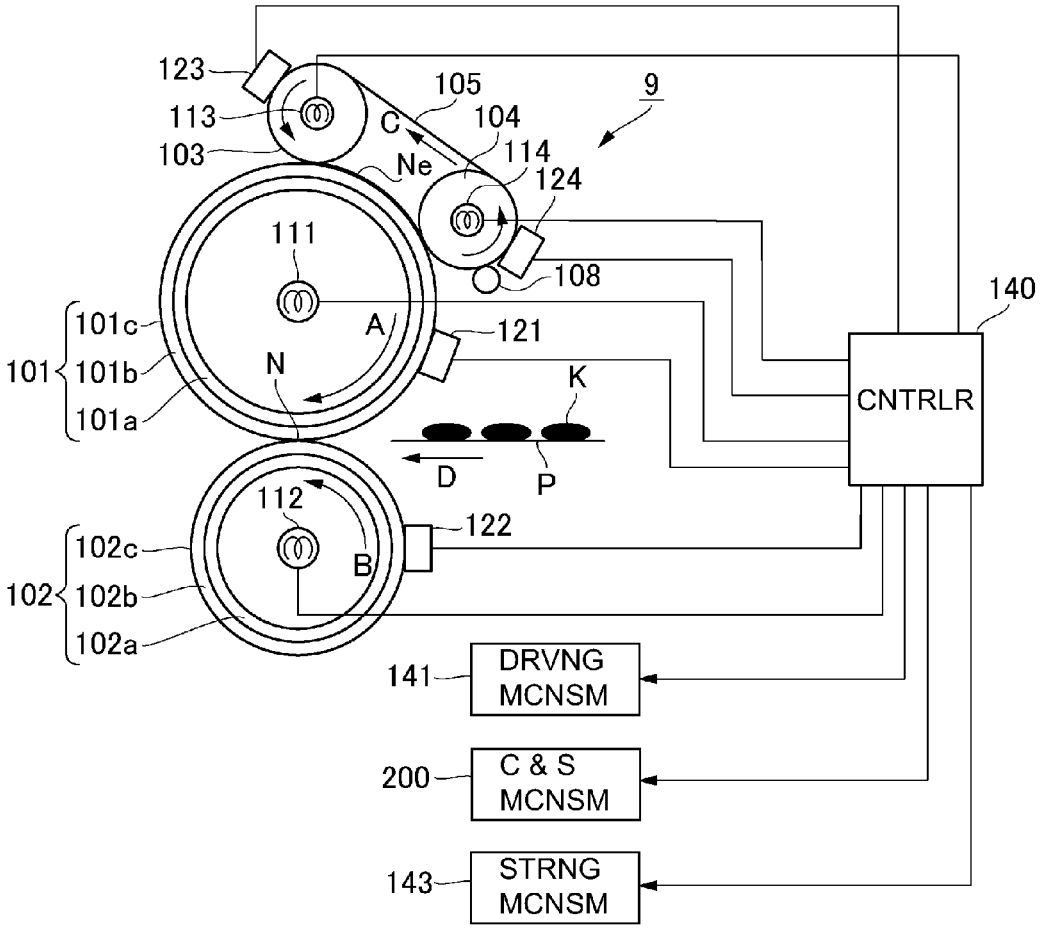
FIG. 2 is an illustration of a structure of a fixing device (apparatus) in Embodiment 1.

FIG. 2 is an illustration of a structure of fixing device functioning as an image heating apparatus.

As shown in FIG. 2, in the fixing device 9, a nip N is formed by causing a pressing roller 102 to press-contact a fixing roller 101 functioning as a rotatable heating member. At the nip N, while nip-conveying the recording material (sheet) P on which an unfixed toner K is carried is nipped and conveyed, an image is fixed on the recording material P by melting the unfixed toner on the recording material P.

The fixing roller 101 includes a core metal 101*a* and an elastic layer 101*b* formed on an outer peripheral surface of the core metal 101*a*, and a surface of the elastic layer 101*b* is coated with a parting layer 101*c*. The fixing roller 101 is rotationally driven by a driving mechanism 141 including an unshown gear train, thus being rotated in an arrow A direction at 300 mm/sec.

The pressing roller 102 includes a core metal 102*a* and an elastic layer 102*b* formed on an outer peripheral surface of the core metal 102*a*, and a surface of the elastic layer 102*b* is coated with a parting layer 102*c*. The pressing roller 102 is rotationally driven by the driving mechanism 141, thus being rotated in an arrow B direction. The pressing roller 102 is driven by an unshown pressing mechanism using an eccentric cam and is movable toward and away from the fixing roller 101. The unshown pressing mechanism presses the pressing roller 102 at predetermined pressure against the fixing roller 101, so that the nip N is formed between the fixing roller 101 and the pressing roller 102.

A halogen heater 111 as a heating mechanism is provided non-rotatably inside the core metal 101*a* of the fixing roller 101. A thermistor 121 is provided in contact with the fixing roller 101 to detect a surface temperature of the fixing roller 101. A controller 140 effects ON/OFF control of the halogen heater 111 depending on a detected temperature by the thermistor 121, thus maintaining the surface temperature of the fixing roller 101 at a predetermined target temperature depending on the type of the recording material P.

A halogen heater 112 is provided non-rotatably inside the core metal 102*a* of the pressing roller 102. A thermistor 122 is provided in contact with the pressing roller 102 to detect a surface temperature of the pressing roller 102. The controller 140 effects ON/OFF control of the halogen heater 112 depending on a detected temperature by the thermistor 122, thus maintaining the surface temperature of the pressing roller 102 at the predetermined target temperature.

(Externally Heating Belt)

Recently, the image forming apparatus 100 is required to output an image with high productivity (the print number per unit time) even with respect to the recording material such as thick paper having a large basis weight (weight per unit area). In order to improve the productivity with respect to the recording material having the large basis weight, it is preferable that speed-up of heating by the fixing device 9 is adhered. However, the recording material having the larger basis weight takes heat in a larger amount, and therefore a heat quantity required for fixing is remarkably large compared with a recording material having a small basis weight.

Therefore, in the fixing device 9 in this embodiment, an externally heating belt 105 which is an endless belt as an externally heating mechanism is used. Specifically, a constitution in which an outer surface temperature is maintained by heating an outer surface (outer portion) of the fixing roller 101 by the externally heating belt 105 is employed.

Incidentally, the externally heating belt 105 has a constitution in which the externally heating belt 105 is movable toward and away from the fixing roller 101 as described later. Further, the externally heating belt 105 has a constitution in which an inner surface thereof is rotatably supported by a plurality of rollers functioning as a supporting portion, i.e., an upstream roller 103 and a downstream roller 104. As a result, an area of contact of the externally heating belt 105 with the fixing roller 101 (i.e., an area of a portion capable of effecting thermal conduction) is increased, so that a function of compensating for the outer surface temperature of the fixing roller 101 is enhanced.

The fixing device 9 is stand-by for a subsequent image forming job (print command) in a state in which the externally heating belt 105 is spaced (separated) from the fixing roller 101. When the image forming job is sent to the image forming apparatus 100, preparatory operations are started in respective devices in the image forming apparatus 100, and a preparatory operation, i.e., a heating operation (warm-up operation) is started also in the fixing device 9. In the heating operation, when temperatures of the fixing roller 101, the pressing roller 102, the upstream roller 103 and the downstream roller 104 reach target temperatures, respectively, the image forming job is started by bringing the externally heating belt 105 into press-contact with the fixing roller 101. Thereafter, when the image forming job is ended, the externally heating belt 105 is spaced from the fixing roller 101 and then is held in this state until the time when subsequent image formation is started.

The externally heating belt 105 is used for externally heating the fixing roller 101 by being contacted to the outer peripheral surface of the fixing roller 101 to form a nip (heating portion) Ne. The externally heating belt 105 includes a base layer of metal such as stainless steel or nickel or of a resin material such as polyimide. A surface of the base layer is coated with a heat-resistant slidable layer using a fluorine-containing resin material in order to prevent deposition of the toner. The externally heating belt 105 is rotated in an arrow contact direction by the rotation of the fixing roller 101.

The upstream roller 103 (supporting roller) is formed of metal, such as aluminum, iron or stainless steel, having high thermal conductivity. A halogen heater 113 is penetrated through the center of the upstream roller 103 and is disposed non-rotatably. A thermistor 123 detects a temperature of the upstream roller 103 in contact with the externally heating belt 105 supported by the upstream roller 103. The controller 140 effects ON/OFF control of the halogen heater 113 depending on a detected temperature by the thermistor 123, thus keeping the temperature of the upstream roller 103 at a predetermined target temperature.

The downstream roller 104 (supporting roller) is formed of metal, such as aluminum, iron or stainless steel, having high thermal conductivity. A halogen heater 114 is penetrated through the center of the downstream roller 104 and is disposed non-rotatably. A thermistor 124 detects a temperature of the downstream roller 104 in contact with the externally heating belt 105 supported by the downstream roller 104. The controller 140 effects ON/OFF control of the halogen heater 114 depending on a detected temperature by the thermistor 124, thus keeping the temperature of the downstream roller 104 at a predetermined target temperature.

The target temperature for temperature adjustment of the upstream roller 103 and the downstream roller 104 is set at a value higher than the target temperature for temperature adjustment of the fixing roller 101. This is because when the surface of the upstream roller 103 and the downstream roller 104 is kept at a value higher than the surface temperature of the fixing roller 101, heat can be efficiently supplied to the fixing roller 101 lowered in surface temperature. During continuous image formation with respect to thick paper, compared with the target temperature of the fixing roller 101 set at 165° C., the target temperature of the upstream roller 103 and the downstream roller 104 is set at 230° C. Thus, the surface temperature of the upstream roller 103 and the downstream roller 104 is kept at a value higher than the surface temperature of the fixing roller 101 by 75° C.

There is a fear that a surface layer of the externally heating belt 105 is contaminated by deposition of a foreign matter, such as the toner or paper powder, transferred (offset) from the recording material. Therefore, a cleaning roller 108 is provided, and the foreign matter, such as the toner or the paper powder, deposited on the belt 105 is adsorbed by a silicone rubber layer provided on a surface of the cleaning roller 108. The cleaning roller 108 is urged at predetermined pressure by the externally heating belt 105 while being rotated by rotation of the externally heating belt 105, thus cleaning the surface of the externally heating belt 105.

(Roller Supporting Mechanism)

Figure 3:
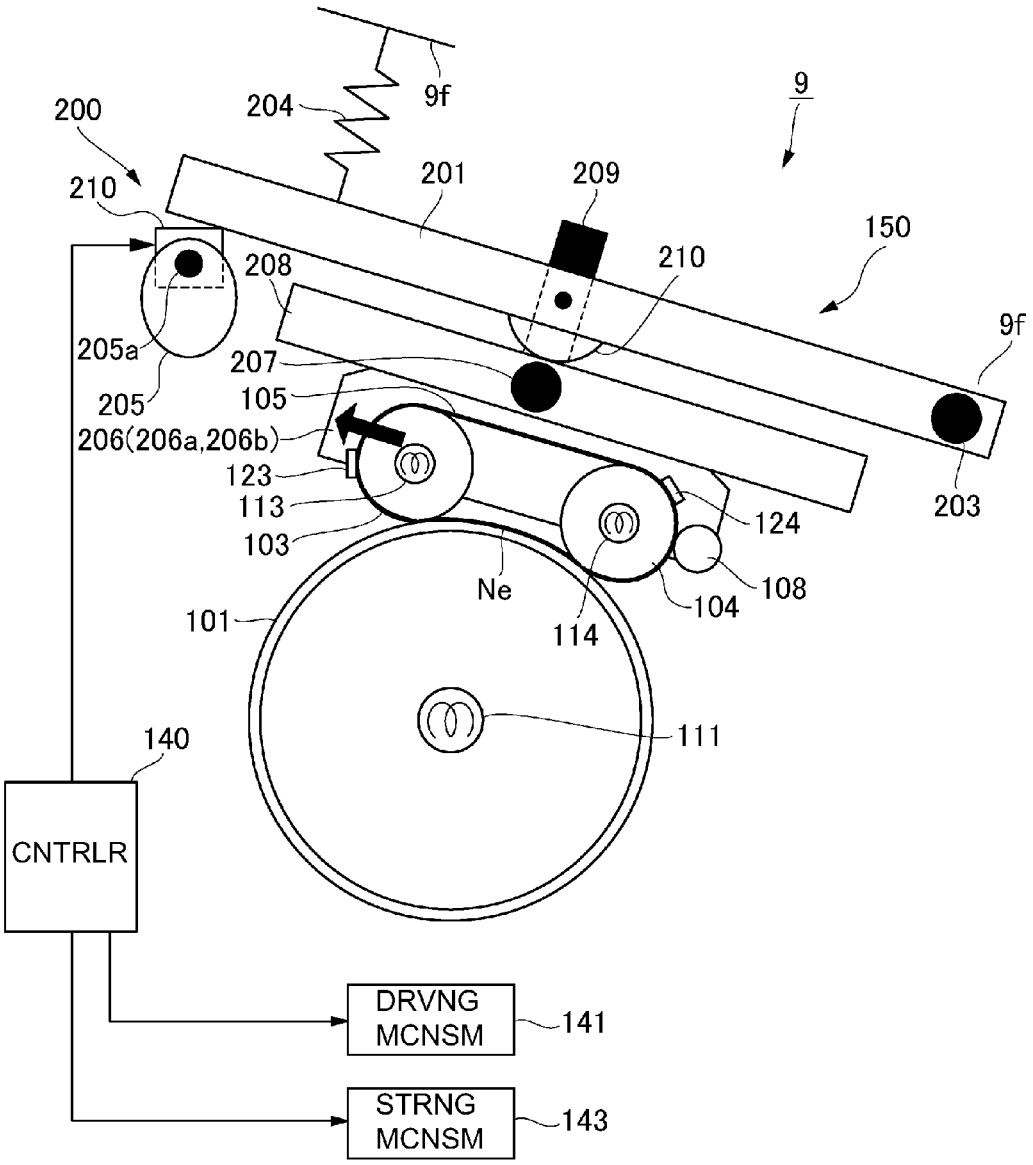
FIG. 3 is an illustration of a structure of a contact and separation mechanism for an externally heating belt.

FIG. 3 is an illustration of a contact and separation mechanism for the externally heating belt. Parts (a) and (b) of FIG. 4 are a perspective view of an outer appearance and a mechanism view, respectively, of the externally heating unit. FIG. 5 is an illustration of a crossing angle between the fixing roller and the externally heating belt.

As shown in FIG. 3, an externally heating unit 150 is extended by the two rollers, i.e., the upstream roller 103 and the downstream roller 104, thus being stretched in a state in which predetermined tension is applied thereto. The externally heating belt 105 is rotatably supported by the upstream roller 103 and the downstream roller 104 so as to be rotated by rotation of the fixing roller 101.

The externally heating belt 105 is movable toward away from the fixing roller 101 by the contact and separation mechanism 200. The contact and separation mechanism 200 also functions as a press-contact mechanism for causing the upstream roller 103 and the downstream roller 104 to press-contact the externally heating belt 105 against the fixing roller 101. A pressing frame 201 is rotatable about a supporting shaft (axis) 203 relative to a casing frame 9*f* of the fixing device 9. Between a rotation end portion of the pressing frame 201 and the casing frame 9*f* of the fixing device 9, a pressing spring 204 is provided. The pressing spring 204 presses down the rotation end portion of the pressing frame 201 to urge a swinging frame 208 toward the fixing roller 101. The swinging frame 208 is rotatably supported relative to the pressing frame 201, by a pair of intermediate rollers 210 provided in front and rear sides of the pressing frame 201. In a state in which the upstream roller 103 and the downstream roller 104 are press-contacted to the externally heating belt 105 against the fixing roller 101, the pressing spring 204 presses the upstream roller 103 and the downstream roller 104 at total pressure of 392 N (about 40 kgf).

A pressure-releasing cam 205 contacts a lower surface of the rotation end portion of the pressing frame 201. The controller 140 (CPU) controls a motor 210 to rotate the pressure-releasing cam 205 about a rotation shaft 205*a*, thus raising and lowering the rotation end portion of the pressing frame 201. When the pressure-releasing cam 205 is spaced from the pressing frame 201, the pressing spring 204 presses down the rotation end portion of the pressing frame 201, so that the externally heating belt 105 is press-contacted to the fixing roller 101. When the pressure-releasing cam 205 compresses the pressing spring 204 to press up the pressing frame 201, the externally heating belt 105 is spaced from the fixing roller 101.

As shown in (a) of FIG. 4, front-side end portions of the upstream roller 103 and the downstream roller 104 are supported by a roller holding frame 206*a* functioning as a supporting portion, and rear-side end portions of the upstream roller 103 and the downstream roller 104 are supported by a roller holding frame 206*b*. Further, as shown in (b) of FIG. 4, the front-side roller holding frame 206*a* is rotatably supported by supporting shafts 207*a* and 207*b* relative to the swinging frame 208 functioning as a supporting portion. Similarly, the rear-side roller holding frame 206*b* is rotatably supported by supporting shafts 207*c* and 207*d* relative to the swinging frame 208. The roller holding frame 206*a* rotatably shaft-supports the front-side end portions of the upstream roller 103 and the downstream roller 104 via unshown heat-resistant bush and bearing. Similarly, the roller holding frame 206*b* rotatably shaft-supports the rear-side end portions of the upstream roller 103 and the downstream roller 104 via unshown heat-resistant bush and bearing.

The pressing spring 204 is disposed at each of longitudinal end portions of the pressing frame 201 functioning as a holding portion. The pair of pressing springs 204 causes the externally heating belt 105 to press-contact the outer peripheral surface of the fixing roller 101 at predetermined pressure via the upstream roller 103 and the downstream roller 104. As shown in FIG. 3, a rectilinear line connecting the supporting shafts 207 (207*a*, 207*b*, 207*c*, 207*d*) and the center of the fixing roller 101 constitutes a perpendicular bisector of a rectilinear line connecting the centers of the upstream roller 103 and the downstream roller 104 in a state in which the externally heating belt 105 is intimately contacted to the fixing roller 101.

As shown in FIG. 5, when detection that the externally heating belt 105 is out of a normal traveling zone (predetermined zone) with respect to a widthwise direction of the externally heating belt 105 is made by a belt position sensor described later, control is effected so that the externally heating belt 105 is returned into the normal traveling zone. That is, the upstream roller 103 and the downstream roller 104 which are in a state in which the rollers 103 and 104 press the externally heating belt 105 against the fixing roller 101 are tilted (rotated) about a tilt (rotation) center 209. As a result, a rotational axis direction of these rollers has a crossing angle θ with respect to a generatrix of the fixing roller 101. Further, when the rollers are placed in such a state, at the rear-side end portions, one of the upstream roller 103 and the downstream roller 104 starts pressure application to the fixing roller 101 ahead of the other. At the same time, at the front-side end portions, the other one of the upstream roller 103 and the downstream roller 104 starts pressure application to the fixing roller 101*a* ahead of one of the rollers (another roller). At this time, a pressure difference between the upstream roller 103 and the downstream roller 104 autonomously rotates the front-side roller holding frame 206*a* and the rear-side roller holding frame 206*b* to cancel an end portion pressure difference between the upstream roller 103 and the downstream roller 104. The front-side roller holding frame 206*a* and the rear-side roller holding frame 206*b* are rotated relative to each other to determine positions of the upstream roller 103 and the downstream roller 104 at tilt positions depending on a curved surface of the fixing roller 101. A relative tilt angle between the upstream roller 103 and the downstream roller 104 varies freely, and therefore attitudes of the upstream roller 103 and the downstream 104 are autonomously corrected to the tilt positions depending on the curved surface of the fixing roller 101, so that the externally heating belt 105 is closely contacted to the fixing roller 101. Both of the upstream roller 103 and the downstream roller 104 are uniformly pressed, so that not only in the front side but also in the rear side, sufficient heating is made from the upstream roller 103 and the downstream roller 104 to the fixing roller 101 via the externally heating belt 105.

(Steering Mechanism)

FIG. 6 is an illustration of a steering mechanism functioning as a tilting (rotating) portion for swinging the externally heating belt in a widthwise direction of the externally heating belt. FIG. 7 is an illustration of a driving portion of the steering mechanism. FIG. 8 is an enlarged view of the driving portion of the steering mechanism.

As shown in FIG. 5, the externally heating belt 105 is capable be being laterally deviated (shifted) and moved in an axial direction of the upstream and downstream rollers 103 and 104 (in a widthwise direction of the belt 105) with rotation thereof by rotation of the fixing roller 101. The cause of this lateral deviation movement is a deviation of parallelism between the upstream roller 103 and the downstream roller 104, and the like. Therefore, in this embodiment, as described above, the crossing angle θ is provided.

Specifically, by providing the crossing angle θ between the externally heating belt 105 and the fixing roller 101, steering control such that a direction of the lateral deviation movement of the externally heating belt 105 is inverted to cause a lateral deviation movement range of the externally heating belt 105 to fall within a predetermined angle range is executed. In this embodiment, the crossing angle θ is controlled within an angle range of ±1.25 degrees on the basis of a reference angle (zero degrees) as an angle at the time when a direction of a generatrix of the fixing roller 101 and an axial direction of the two rollers 103 and 104 are substantially in parallel with each other.

As shown in FIG. 6, the fixing roller 101 is rotatably supported by main assembly side plates 202 as an example of a supporting casing. The externally heating belt 105 is rotated by the rotation of the fixing roller 101 while forming a contact surface (heating portion) between the externally heating belt 105 and the fixing roller 101. The upstream roller 103 and the downstream roller 104 which are a plurality of supporting rollers (supporting portions) stretch the externally heating belt 105.

The pressing frame 201 functioning as the holding portion is detachably mounted between the main assembly side plates 202. The pressing frame 201 rotatably supports the upstream and downstream rollers 103 and 104 as a unit so as to form the crossing angle θ between the generatrix of the fixing roller 101 and the generatrix the externally heating belt 105 (i.e., the rotational axis of the rollers 103 and 104) at the contact surface.

The swingable frame 208 functioning as the supporting portion rotatably supports the upstream and downstream rollers 103 and 104, and is rotatably supported by the pressing frame 201 so as to provide the crossing angle θ. The pressing frame 201, the swingable frame 208, the upstream roller 103, the downstream roller 104 and the externally heating belt 105 are integrally assembled to constitute the externally heating unit 150.

A worm wheel 118 functioning as a tilting (rotating) portion tilts the swingable frame 208 relative to the pressing frame 201, i.e., rotates a lower portion 150L (FIG. 12) of the externally heating unit 150 relative to an upper portion 150U (FIG. 12). The controller 140 controls an operation of the worm wheel 118 to control the lateral deviation movement of the externally heating belt 105 along the upstream roller 103 and the downstream roller 104.

The controller 140 tilts, as a unit, about a rotation shaft (swinging shaft) 209, the upstream roller 103 and the downstream roller 104 which stretch the externally heating belt 105 to intentionally set the crossing angle θ between the externally heating belt 105 and the fixing roller 101, thus controlling the lateral deviation direction of the externally heating belt 105. The rotation shaft (swinging shaft) 209 is a rotation center (swinging center) for changing the crossing angle θ between the externally heating belt 105 and the fixing roller 101. The rotation shaft 209 is a shaft portion extending in substantially parallel to a direction of a normal to a flat surface (upper surface of FIG. 3), of the externally heating belt 105 in a side remote from the fixing roller 101, of surfaces of the externally heating belt 105 located belt the two rollers (103, 104). The supporting shaft 203 of the pressing frame 201 is fixed between the main assembly side plates 202 at ends thereof. The swinging frame 208 and the externally heating belt 105 are rotatable as a unit, relative to the pressing frame 201, about the rotation shaft 209. The supporting shaft 207*a* fixed on the swinging frame 208 is held with a clearance from the main assembly side plate 202, and is movable in arrow H and J directions, in a clearance range, with movement of an arm portion 118*a* of the worm wheel 118.

The sector worm wheel 118 rotatable about the rotation shaft 119 is engaged with a worm gear 120. When the motor 125 is rotated in a normal direction to rotate the worm wheel 118 in an arrow G, the arm portion 118*a* is moved in the arrow H direction to move the supporting shaft 207*a* in the arrow H direction. When the motor 125 is rotated in a reverse direction to rotate the worm wheel 118 in an arrow I direction, the arm portion 118*a* is moved in the arrow J direction to move the supporting shaft 207*a* in the arrow J direction (FIGS. 7 and 8).

When the swinging frame 208 is moved in the arrow H or J direction in the front side, the upstream roller 103 and the downstream roller 104 are rotated around the rotation shaft 209, so that the crossing angle θ is set between the fixing roller 101 and the upstream and downstream rollers 103 and 104. There is a relationship the crossing angle θ between the fixing roller 101 and the externally heating belt 105 and a lateral deviation (shift) speed of the externally heating belt 105. A lateral deviation force of the externally heating belt 105 is changed depending on an amount of movement of the arm portion 118*a*, so that a direction and speed of the lateral deviation (movement) of the externally heating belt 105 along the upstream and downstream rollers 103 and 104 are controlled.

In the case where the supporting shaft 207*a* is moved from a point where the shift force is zero to the H direction, the shift force for moving the externally heating belt 105 toward the rear side (arrow M direction) of the fixing roller 101 becomes large. In the case where the supporting shaft 207*a* is moved from the point where the shift force is zero to the J direction, the shift force for moving the externally heating belt 105 toward the front side (arrow L direction) of the fixing roller 101 becomes large. In this way, by moving the supporting shaft 207*a* in the arrow H and J directions, a direction in which the externally heating belt 105 is shifted can be controlled.

(Belt Position Sensor)

FIG. 9 is an illustration of an arrangement of a belt position sensor as a detecting portion. Parts (a) and (b) of FIG. 10 are illustrations each showing a relationship between a belt lateral deviation direction and a sensor flag rotational direction.

As shown in FIG. 9, the belt position sensor principally includes, as constituent elements thereof, a roller 128 contacted to a widthwise edge of the externally heating belt 105, an arm 129 connected with the roller 128, a sensor flag 132 connected with the arm 129, and photo-interrupters 133 and 134 for detecting a rotation position of the sensor flag 132. Description will be made specifically below.

The arm 129 and the roller 128 rotate as a unit about a rotation shaft 136. The sensor flag 132 rotates about a rotation shaft 137. The arm 129 and the sensor flag 132 are engaged by a link portion 138 to transmit a rotational force. The roller 128 contacts a belt edge of the externally heating belt 105. A torsion spring 131 as an urging portion urges the roller 128 in an arrow Q direction by applying a torque to the arm 129. For that reason, when the externally heating belt 105 is shifted (laterally deviated) in the arrow Q direction, the link portion 138 is moved in an arrow P direction so as to follow the shifted externally heating belt 105. On the other hand, when the externally heating belt 105 is shifted in an arrow R direction, similarly, the link portion 138 is moved in an arrow O direction.

Along the sensor flag 132, photo-interruptors 133 and 134 are provided. The photo-interruptors 133 and 134 detect four edges of the two slits SL1 and SL2 formed in the sensor flag 132 and invert outputs of the detection. Correspondingly to the four edges of the sensor flag 132, lateral deviation positions of the externally heating belt 105 are defined. As an example, the photo-interruptors 133 and 134 are disposed so that the externally heating belt 105 repeats the lateral deviation movement with an amplitude of 5 mm.

As shown in (a) of FIG. 10, in the case where the externally heating belt 105 is shifted in the arrow R direction, the arm 129 is rotated in an arrow S direction, so that the sensor flag 132 is rotated in an arrow T direction to turn off the photo-interruptor 133 and to turn on the photo-interruptor 134. As shown in (b) of FIG. 10, in the case where the externally heating belt 105 is shifted in the arrow Q direction, the arm 129 is rotated in an arrow U direction, so that the sensor flag 132 is rotated in an arrow V direction to turn on the photo-interruptor 133 and to turn off the photo-interruptor 134.

(Comparison Example)

Part (a) of FIG. 11 is an illustration of rotation of a swingable frame of a fixing device in Comparison example. As shown in (a) of FIG. 11, in a fixing device 9H in Comparison example, a swingable frame 208 is rotatable about a rotation shaft 209 relative to a pressing frame 201 similarly as in Embodiment 1. For this reason, when the pressing frame 201 is demounted from and mounted into a casing of the fixing device 9H, the swingable frame 208 is rotated, and thus can contact peripheral parts. For that reason, when an externally heating unit 150H is assembled with the casing of the fixing device 9H, an attitude of the swingable frame 208 is not fixed, so that there is a fear that the swingable frame 208 constitute an obstacle to a mounting operation of the externally heating unit 150H.

In an exchanging (replacing) operation of the externally heating unit 150H, the demounted externally heating unit 150H is placed on a table in a state in which a surface of the pressing frame 201 is directed downward. In this state, when a roller holding frame 206 in a side is demounted, the externally heating belt 105 is capable of being pulled out along the upstream and downstream rollers 103 and 104.

In Comparison example, in the case where the externally heating belt 105 is replaced, the swingable frame 208 can be rotated with no limitation, and therefore it takes much time to demount and mount the externally heating belt 105. In a state in which the externally heating unit 150H can be rotated with no limitation, a position of the roller frame 206 is not stabilized, and therefore the roller holding frame 206 constitutes an obstacle to the exchanging operation of the externally heating belt 105.

Therefore, in Embodiment 1, the externally heating unit 150 is provided with a limiting mechanism for preventing (limiting) rotation of the swingable frame 208 so that an angle of rotation is less than a predetermined angle. When the externally heating unit 150 is assembled with the casing of the fixing device 9, the rotation of the swingable frame 208 will fall within a certain range, and as a result, the assembling of the externally heating unit 150 with the casing of the fixing device 9 is facilitated.

(Limiting Mechanism)

FIG. 12 is an illustration of a structure of an externally heating unit. FIG. 13 is an illustration of a structure of a pressing frame. FIG. 14 is an illustration of a structure of the swingable frame. Parts (a), (b) and (c) of FIG. 15 are illustrations of tilt (rotation) limitation of the swingable frame. FIG. 16 is an illustration of a relationship between a crossing angle and tilt limit angle.

As shown in FIG. 12, a rotatable limiting member 211 functioning as a limiting portion limits, in a state in which the externally heating unit 150 is demounted from the main assembly side plates 202, a tilt (rotation) angle of the swingable frame 208 relative to the pressing frame 201 within a predetermined angle range (within ±4 degrees in this embodiment). The rotatable limiting member 211 is a mechanism for providing the tilt angle of the swingable frame 208 relative to the pressing frame 201 with a limit within the predetermined angle range. As shown in FIG. 16, a tolerable angle range β (4 degrees in this embodiment) by the rotatable limiting member 211 includes therein an angle range (θ in FIG. 5) αmax (1.25 degrees) in which the swingable frame 208 is capable of crossing within an axis of the pressing frame 201 by the steering mechanism. Here, a broken line O in FIG. 16 shows a state in which the externally heating belt 105 does not substantially cross with the fixing roller 101 as described above, i.e., a state in which the rotational axis of the two rollers 103 and 104 is substantially in parallel to the rotation axis (generatrix) of the fixing roller 101.

As shown in FIG. 12, the externally heating unit 150 is roughly divided into the upper portion 150U including the pressing frame 201 and the lower portion 150L including the externally heating belt 105 and the swingable frame 208. As shown in FIG. 6, the externally heating unit 150 is supported rotatably by the supporting shaft 203 between the main assembly side plates 202 of the fixing device 9.

The lower portion 150L of the externally heating unit 150 is supported by the rotation shaft 209 so as to be hung from the pressing frame 201, thus being rotatable about the rotation shaft 209 relative to the upper portion 150U. Even when the lower portion 150L is rotated relative to the upper portion 150U, a parallel relationship between the fixing device 9 and the pressing frame 201 is kept constant, and at the same time, a parallel relationship of the swingable frame 208 with the upstream and downstream rollers 103 and 104 is kept constant.

As shown in FIG. 13, on a lower surface of the pressing frame 201, the rotatable limiting member 211 is fixed.

As shown in FIG. 14, at an upper surface of the swingable frame 208, each of side surfaces 208*a* and 208*b* in a tilt (rotation) center region of the swingable frame 208 is projected outward in a trapezoidal shape by drawing a metal plate material.

As shown in (a) of FIG. 15, the swingable frame 208 is rotatable about the rotation shaft 209 relative to the pressing frame 201 as indicated by arrows. However, the rotatable limiting member 211 of the pressing frame 201 enters an inside of the side surfaces 208*a* and 208*b*. For this reason, a tilt (rotation) range of the swingable frame 208 relative to the pressing frame 201 is limited by a tilt (rotation) angle at which the rotatable limiting member 211 abuts against inner wall surfaces of the side surfaces 208*a* and 208*b*.

As shown in (b) of FIG. 15, in the case where the swingable frame 208 is rotated counterclockwise as seen from above, the side surface 208*a* of the swingable frame 208 contacts the rotatable limiting member 211 to constitute a stopper, so that the rotation (tilting) of the swingable frame 208 is limited.

As shown in (c) of FIG. 15, in the case where the swingable frame 208 is rotated clockwise as seen from above, the side surface 208*b* of the swingable frame 208 contacts the rotatable limiting member 211 to constitute a stopper, so that the rotation (tilting) of the swingable frame 208 is limited.

As shown in FIG. 5, the crossing angle, between the fixing roller 101 and the externally heating belt 105, used when the direction of the lateral deviation movement of the externally heating belt 105 is inverted is ±θ (±1.25 degrees in this embodiment). Further, in the case where the direction of the lateral deviation movement is not inverted by the inversion at the crossing angle θ, in order to obviate complete lateral deviation (movement), a crossing angle of ±θmax (±2.5 degrees) set at a value which is twice the crossing angle of ±e is employed.

As shown in FIG. 16, an angle formed between the swingable frame 208 and the pressing frame 201 in a state in which the swingable frame 208 is limited by the rotatable limiting member 211 is taken as β. In Embodiment 1, the tilt angle between the swingable frame 208 and the pressing frame 201 is limited by the tilt angle β larger than α which is twice the crossing angle θmax, so that the swingable frame 208 is prevented from being rotated (tilted) further.

$$\beta \geq \alpha max$$

In this embodiment, the angle β varies depending on component tolerance, and therefore β>αmax is used as a design value. In the case where the angle β is smaller than αmax, in the lateral deviation control of the externally heating belt 105, the swingable frame 208 cannot be rotated to the angle of ±θmax, so that the rotation of the swingable frame 208 is stopped at the angle β. In Embodiment 1, αmax is 2 degrees and β is 4 degrees.

The rotatable limiting member 211 contacts the swingable frame 208 in the neighborhood of the rotation shaft 209, so that the rotation (tilting) of the externally heating unit 150 as a whole is limited. However, in order to decrease a degree of the influence on the tilt angle β due to variation in dimension at a position of the contact surface, it is desirable that a portion for limiting torsion of the externally heating unit at a position remote from the central rotation shaft 209 is provided.

In this embodiment, in a constitution in which heat is supplied to the fixing roller 101 by using the externally heating belt 105, the rotation shaft 209 is provided in the externally heating unit 150 to change the crossing angle θ, so that the lateral deviation movement of the externally heating belt 105 is controlled. At that time, the rotatable limiting member 211 for limiting the rotation of the externally heating belt 105 is provided, so that the assembling of the externally heating unit 150 with the fixing device 9 is facilitated.

In this embodiment, the rotatable limiting member 211 contacts the side surfaces 208*a* and 208*b* of the swingable frame 208, so that the rotation of the swingable frame 208 relative to the pressing frame 201 is limited and thus a deflection angle of the externally heating unit 150 is limited. In this way, by setting a tilt (rotation) limit angle is set, so that the control of the lateral deviation movement of the externally heating belt 105 is prevented from being influenced by the reflection angle of the externally heating unit 150.

In this embodiment, when the externally heating unit 150 is raised alone, the swingable frame 208 is not largely rotated, and therefore an operation for mounting the externally heating unit 150 between the main assembly side plates 202 of the fixing device 9 is easy. By mounting the externally heating unit 150 in a state in which the attitude of the externally heating belt 105 is fixed, different from Comparison example shown in FIG. 11, a position relationship between the externally heating unit 150 and the main assembly side plates 202 is not largely destroyed. For this reason, a possibility of contact between parts when the shaft 207*a* is engaged into the arm portion 118*a* becomes small.

In this embodiment, in the externally heating unit 150, a maximum tilt angle is limited between a portion, to be fixed between the main assembly side plates 202, for holding the fixing roller 101 and a portion, disposed rotatably relative to the portion, for holding the externally heating belt 105. By making the limited angle larger than an angle used during the lateral deviation control, the influence on the lateral deviation control of the externally heating belt 105 is eliminated.

In this embodiment, in order to effect the lateral deviation control of the externally heating belt 105, although a constitution in which the externally heating belt 105 itself is twisted is employed, the attitude of the externally heating belt 105 is fixed when the externally heating unit 150 is mounted between the main assembly side plates 202. For this reason, the mounting of the externally heating unit 150 is easy. The rotation is limited to an angle larger than a maximum of the torsional angle used in the lateral deviation control of the externally heating belt 105, and therefore the lateral deviation control of the externally heating belt 105 is not adversely affected.

(Embodiment 2)

FIG. 17 is a front view of a demounted state of an externally heating unit in Embodiment 2. FIG. 18 is a plan view of the demounted state of the externally heating unit in this embodiment. FIG. 19 is a front view of a mounted state of the externally heating unit in this embodiment. FIG. 20 is a plan view of the mounted state of the externally heating unit in this embodiment.

As shown in (b) of FIG. 11, in Embodiment 1, the rotation of the externally heating unit 150 is limited, but the externally heating unit 150 is still rotatable (tiltable) within a limited range, and therefore there is a fear that the rotation of the externally heating unit 150 constitute an obstacle to positioning of the supporting shaft 207*a* relative to the arm portion 118*a*.

Therefore, in this embodiment, as shown in FIG. 17, in addition to the constitution of Embodiment 1, a lock mechanism 160 for stopping the rotation (tilting) of the swingable frame 208 by being actuated with mounting and demounting of the externally heating unit 150 was provided. In Embodiment 2, the constitution except for the lock mechanism 160 is the same as the constitution in Embodiment 1, and therefore in FIGS. 17 to 20, constituent elements common to Embodiments 1 and 2 are represented by the same reference numerals or symbols and will be omitted from redundant description.

As shown in FIG. 19, the lock mechanism 160 as the lateral deviation is a mechanism for limiting the rotation of the swingable frame 208 relative to the pressing frame 201 with a demounting operation of the pressing frame 201 as an example of a predetermined part (component). The pressing frame 201 is one of parts to be demounted for removing, from between the main assembly side plates 202, the pressing frame 201, the swingable frame 208, the upstream roller 103, the downstream roller 104 and the externally heating belt 105. The lock mechanism 160 eliminates limitation of the tilting of the swingable frame 208 relative to the pressing frame 201 with the mounting operation of the pressing frame 201.

A fixing cover 214 is an example of the predetermined part or a part of which position is fixed relative to the predetermined part. A rotation stopping member 213 as an example of a lever member is shaft-supported by the pressing frame 201 and is contactable to the swingable frame 208 at an rotation end thereof. An elastic member 212 as an example of an urging means urges the rotation stopping member 213 in a direction in which the rotation and is contacted to the swingable frame 208. In a state in which the pressing frame 201 is mounted between the main assembly side plates 202, the fixing member 214 rotates the rotation stopping member 213 against the urging by the elastic member 212, so that the rotation end is spaced from the swingable frame 208.

As shown in FIG. 17, the lock mechanism 160 is disposed on the pressing frame 201 of the externally heating unit 150. The lock mechanism 160 supports the rotation stopping member 213 rotatably about a rotation shaft 213*b*. The rotation stopping member 213 is urged toward the swingable frame 208 by the elastic member 212 which is a torsion spring. The lock mechanism 160 fixes, in the case of the externally heating unit 150 alone, relative rotation between the swingable frame 208 and the pressing frame 201 to improve an exchanging property of the externally heating belt 105 alone.

As shown in FIG. 18, the roller holding frame 206 holds the supporting rollers 103 and 104 by which the externally heating belt 105 is stretched. The roller holding frame 206 is in a torsional relationship with the pressing frame 201 via the swingable frame 208. The rotation stopping member 213 is disposed at two positions in front and rear sides of the rotation shaft 209 with respect to the longitudinal direction of the externally heating unit 150. In a state in which the externally heating unit 150 is demounted from the fixing device 9, the rotation stopping member 213 urged by the elastic member 212 contacts the swingable frame 208 to stop the rotation of the swingable frame 208 relative to the pressing frame 201. The lock mechanism 160 prevents torsion between the pressing frame 201 and the swingable frame 208 to fix a positional relationship therebetween.

As shown in FIG. 19, the lock mechanism 160 eliminates fixing of relative rotation between the swingable frame 208 and the pressing frame 201 when the externally heating unit 150 is mounted between the main assembly side plates 202 of the fixing device 9, so that the lateral deviation movement control of the externally heating belt 105 is enabled. In a process in which the externally heating unit 150 is assembled into the fixing device 9, a projected portion 215 disposed on the fixing cover 214 of the fixing device 9 pushes the rotation stopping member 213 to rotate the rotation stopping member 213.

As shown in FIG. 20, when the lock mechanism 160 is released, the rotation stopping member 213 is retracted from the swingable frame 208, so that the swingable frame 208 is rotatable relative to the pressing frame 201.

In Embodiment 2, in the case of the externally heating unit 150 alone, the swingable frame 208 and the pressing frame 201 are fixed, and when the externally heating unit 150 is mounted in the fixing device 9, the swingable frame 208 is rotatable relative to the pressing frame 201. For this reason, different from a lock mechanism to be manually operated, there is no need to perform manual locking and release of the manual locking.

In this embodiment, the lock mechanism 160 is added, and therefore compared with Embodiment 1, there is a demerit such that the constitution is complicated and thus a cost is increased. However, the lock mechanism 160 prevents the torsion between the swingable frame 208 and the pressing frame 201 in the case of the externally heating unit 150 alone, and therefore the exchanging property of the externally heating belt 105 is improved compared with Embodiment 1. When the externally heating unit 150 is mounted on the table with the pressing frame 201 downward, the upstream roller 103 and the downstream roller 104 are rotated and are not deviated, and therefore the operation property when the externally heating belt 105 is replaced is improved compared with Embodiment 1.

The lock mechanism 160 in this embodiment may also be used singly without being combined with the rotatable limiting member 211 in Embodiment 1. The lock mechanism 160 is not limited to a mechanism for controlling locking and release of the locking by urging the lever against the projection of the fixing cover. The lock mechanism 160 may also be substituted with a mechanism for locking the swingable frame 208 with the demounting operation of the externally heating unit 150 from between the main assembly side plates 202.

In the above, Embodiments 1 and 2 to which the present invention is applied are described, but within the range of the concept of the present invention, a part or all of the constitutions described in Embodiments 1 and 2 can be substituted with alternative constitutions thereof.

For example, the heating mechanism (heater) for the fixing roller and the externally heating belt is not limited to the halogen heater but may also be replaced with a mechanism for heating through electromagnetic induction heating by providing an exciting coil.

Further, the rotatable heating member to be heated by the externally heating belt is not limited to the fixing roller but may also be the pressing roller.

The image heating apparatus includes, in addition to the fixing device, a surface heating apparatus for adjusting image gloss and a surface property of a partly or completely fixed image, and includes a curl removing apparatus of the recording material on which the fixed image is formed. The image heating apparatus may also be, other than in the constitution in which the image heating apparatus is assembled with the image forming apparatus, carried out as a single apparatus or component which is disposed and operated alone. The image forming apparatus can be carried irrespective of types of monochromatic/full-color, sheet-feeding/recording material conveyance intermediary transfer, toner image formation, and toner image transfer. The present invention can be carried out in the image forming apparatuses in various fields, such as printers, various printing machines, copying machines, facsimile machines and multi-function machines, by adding a device, equipment and a casing structure which are necessary for the image heating apparatus.

Further, in Embodiments 1 and 2, as an example to which the present invention is applied, the image heating apparatus (fixing device) is described, but, e.g., the present invention is similarly applicable to also the following constitution.

For example, the present invention is applicable to a constitution in which an endless intermediary transfer belt as the intermediary transfer member is used. In this constitution, the intermediary transfer belt is configured to be rotatable by two supporting rollers so as to be rotated by rotation of the photosensitive member, and such intermediary transfer belt and two supporting rollers are disposed to cross as a unit with the generatrix direction (axial direction) of the photosensitive member similarly as in the above-described embodiments. In this way, the present invention can be similarly applied as a lateral deviation mechanism for the intermediary transfer belt. In addition, the present invention is also applicable to an endless belt, to be provided in the image forming apparatus, configured to be rotatably supported at an inner surface thereof by two supporting rollers so as to be rotated by rotation of a rotatable driving member. In this case, the endless belt and the two supporting rollers are constituted to cross as a unit with the generatrix direction (axial direction) of the rotatable driving member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 263768/2012 filed Nov. 30, 2012, which is hereby incorporated by reference.

What is claimed is:

1. An image heating apparatus comprising:

a rotatable heating member configured to heat an image on a sheet;

a belt unit including an endless belt configured to heat said rotatable heating member by contacting an outer surface of said rotatable heating member, and first and second supporting members configured to rotatably support an inner surface of said endless belt;

a holding mechanism configured to rotatably hold said belt unit;

a detector configured to detect that said endless belt is out of a predetermined zone with respect to a widthwise direction of said endless belt;

a tilting device configured to tilt said belt unit relative to said holding mechanism in a direction of causing said endless belt to return into the predetermined zone on the basis of an output of said detector; and a limiting mechanism configured to limit tilting of said belt unit to an angle exceeding a predetermined angle range wider than an angle range in which said belt unit is capable of being tilted by said tilting device.

2. An image heating apparatus according to claim 1, wherein said limiting mechanism is provided on said holding mechanism.

3. An image heating apparatus according to claim 1, wherein each of said first and second supporting members is a roller in which a heater is incorporated.

4. An image heating apparatus according to claim 1, further comprising a driving mechanism configured to rotationally drive said rotatable heating member, wherein said endless belt is constituted so as to be rotated by rotation of said rotatable heating member.

5. An image heating apparatus according to claim 1, wherein said rotatable heating member is a roller.

6. An image heating apparatus according to claim 1, further comprising a nip forming member configured to form a nip for nipping and conveying the sheet between said nip forming member and said rotatable heating member.

7. An image heating apparatus comprising:

a rotatable heating member configured to heat a toner image on a sheet;

a belt unit including an endless belt configured to heat said rotatable heating member by contacting an outer surface of said rotatable heating member, and first and second rollers configured to rotatably support an inner surface of said endless belt;

a detector configured to detect a widthwise position of said endless belt;

a tilting device configured to tilt, on the basis of an output of said detector, said belt unit so that an axis of each of said first and second rollers in a state in which said rollers press said endless belt against said rotatable heating member crosses with a generatrix of said rotatable heating member; and a limiting mechanism configured to limit tilting of said belt unit to an angle exceeding a predetermined angle range wider than an angle range of said belt unit tilted by said tilting device.

8. An image heating apparatus according to claim 7, wherein said limiting mechanism is provided on said holding mechanism.

9. An image heating apparatus according to claim 7, wherein each of said first and second rollers includes a heater incorporated therein.

10. An image heating apparatus according to claim 7, further comprising a driving mechanism configured to rotationally drive said rotatable heating member, wherein said endless belt is constituted so as to be rotated by rotation of said rotatable heating member.

11. An image heating apparatus according to claim 7, wherein said rotatable heating member is a roller.

12. An image heating apparatus according to claim 7, further comprising a nip forming member configured to form a nip for nipping and conveying the sheet between said nip forming member and said rotatable heating member.

13. An image heating apparatus comprising:

a rotatable heating member configured to heat a toner image on a sheet;

an endless belt configured to heat said rotatable heating member by contacting an outer surface of said rotatable heating member;

two rollers configured to rotatably support an inner surface of said endless belt;

a supporting mechanism configured to support said two rollers;

a holding mechanism configured to swingably hold said supporting mechanism;

a detector configured to detect a widthwise position of said endless belt;

a swinging device configured to swing, on the basis of an output of said detector, said supporting mechanism relative to said holding mechanism so that each of said two rollers in a state in which said two rollers press said endless belt against said rotatable heating member crosses with said rotatable heating member; and a limiting mechanism configured to limit swinging of said supporting mechanism relative to said holding mechanism to an angle exceeding a predetermined angle range wider than an angle range in which said belt unit is capable of being swung by said swinging device.

14. An image heating apparatus according to claim 13, wherein said swinging device is provided on an opposite side from said rotatable heating member with respect to said endless belt and has a swinging shaft which is positioned between said two rollers and which is substantially parallel to a direction of normal to a flat surface of said endless belt in a side remote from said rotatable heating member, and wherein said swinging device swings said holding mechanism about the swinging shaft on the basis of an output of said detector.

15. An image heating apparatus comprising:

a rotatable heating member configured to heat an image on a sheet;

a belt unit including an endless belt configured to heat said rotatable heating member by contacting an outer surface of said rotatable heating member, and first and second supporting members configured to rotatably support an inner surface of said endless belt;

a detector configured to detect that said endless belt is out of a predetermined zone with respect to a widthwise direction of said endless belt;

a tilting device configured to tilt said belt unit in a direction of causing said endless belt to return into the predetermined zone on the basis of an output of said detector; and a limiting mechanism configured to limit tilting of said belt unit.

16. An image heating apparatus according to claim 15, wherein said tilting device tilts said belt unit within a predetermined angle range about a predetermined tilt center, and wherein said limiting mechanism-limits the tilting of said belt unit to an angle exceeding an angle range wider than the predetermined angle range.

17. An image forming apparatus comprising:

a belt unit including an endless belt and first and second supporting members configured to rotatably support an inner surface of said endless belt;

a rotatable driving member configured to rotate said endless belt by rotation thereof in contact with an outer surface of said endless belt;

a holding mechanism configured to rotatably hold said belt unit;

a detector configured to detect that said endless belt is out of a predetermined zone with respect to a widthwise direction of said endless belt;

a tilting device configured to tilt said belt unit relative to said holding mechanism in a direction of causing said endless belt to return into the predetermined zone on the basis of an output of said detector; and a limiting mechanism configured to limit tilting of said belt unit to an angle exceeding a predetermined angle range wider than an angle range in which said belt unit is capable of being tilted by said tilting device.

18. An image forming apparatus comprising:

a belt unit including an endless belt and first and second rollers configured to rotatably support an inner surface of said endless belt;

a rotatable driving member configured to rotate said endless belt by rotation thereof in contact with an outer surface of said endless belt;

a holding mechanism configured to rotatably hold said belt unit;

a detector configured to detect a widthwise position of said endless belt;

a tilting device configured to tilt, on the basis of an output of said detector, said belt unit relative to said holding mechanism so that an axis of each of said first and second rollers in a state in which said first and second rollers press said endless belt against said rotatable heating member crosses with a generatrix of said rotatable heating member; and a limiting mechanism configured to limit tilting of said belt unit to an angle exceeding a predetermined angle range wider than an angle range in which said belt unit is capable of being tilted by said tilting device.

19. An image heating apparatus comprising:

an endless belt;

two rollers configured to rotatably support an inner surface of said endless belt;

a rotatable driving member configured to rotate said endless belt by rotation thereof in contact with an outer surface of said endless belt;

a supporting mechanism configured to support said two rollers;

a holding mechanism configured to swingably hold said supporting mechanism;

a detector configured to detect a widthwise position of said endless belt;

a swinging device configured to swing, on the basis of an output of said detector, said supporting mechanism relative to said holding mechanism so that said each of said two rollers in a state in which said two rollers press said endless belt against said rotatable heating member crosses with said rotatable heating member; and a limiting mechanism configured to limit swinging of said supporting mechanism relative to said holding mechanism to an angle exceeding a predetermined angle range wider than an angle range in which said belt unit is capable of being swung by said swinging device.

20. An image heating apparatus according to claim 19, wherein said swinging device is provided on an opposite side from said rotatable driving member with respect to said endless belt and has a swinging shaft which is positioned between said two rollers and which is substantially parallel to a direction of normal to a flat surface of said endless belt in a side remote from said rotatable driving member, and wherein said swinging device swings said supporting mechanism about the swinging shaft on the basis of an output of said detector.

* * * * *